US009187938B2

(12) United States Patent
Pluta

(10) Patent No.: US 9,187,938 B2
(45) Date of Patent: Nov. 17, 2015

(54) WIRELESS-ACTUATED WALL-MOUNTED DEADBOLT SYSTEM

(71) Applicant: Michael Richard Pluta, Huntington Beach, CA (US)

(72) Inventor: Michael Richard Pluta, Huntington Beach, CA (US)

( * ) Notice: Subject to any disclaimer, the term of this patent is extended or adjusted under 35 U.S.C. 154(b) by 0 days.

(21) Appl. No.: 14/252,245

(22) Filed: Apr. 14, 2014

(65) Prior Publication Data

US 2015/0075233 A1 Mar. 19, 2015

Related U.S. Application Data

(60) Provisional application No. 61/878,231, filed on Sep. 16, 2013.

(51) Int. Cl.
*E05B 47/00* (2006.01)
*E05C 1/02* (2006.01)

(52) U.S. Cl.
CPC ..... *E05C 1/02* (2013.01); *E05B 47/0001* (2013.01); *Y10T 70/5319* (2015.04)

(58) Field of Classification Search
CPC ... E05B 47/02; E05B 47/026; E05B 47/0002; E05B 47/0004; E05B 47/0001; Y10T 70/5319; E05C 1/02
USPC ..... 70/277, 278.7, 279.1, 280–282; 292/144, 254, 341.16
See application file for complete search history.

(56) References Cited

U.S. PATENT DOCUMENTS

| | | | | | |
|---|---|---|---|---|---|
| 1,089,324 | A * | 3/1914 | Chesley | 292/213 | |
| 3,614,147 | A * | 10/1971 | Spector | 292/254 | |
| 3,872,696 | A * | 3/1975 | Geringer | 70/145 | |
| 3,998,483 | A * | 12/1976 | Yan | 292/254 | |
| 4,132,439 | A * | 1/1979 | Millar | 292/144 | |
| 4,271,691 | A * | 6/1981 | Logan | 70/422 | |
| 4,902,052 | A * | 2/1990 | Laine | 292/144 | |
| 5,474,342 | A * | 12/1995 | Smith et al. | 292/254 | |
| 5,531,086 | A * | 7/1996 | Bryant | 70/279.1 | |
| 5,911,460 | A * | 6/1999 | Hawkins et al. | 292/254 | |
| 6,580,355 | B1 * | 6/2003 | Milo | 340/5.7 | |
| 2006/0049648 | A1 * | 3/2006 | Stein | E05B 47/0047 292/341.16 | |
| 2009/0217718 | A1 * | 9/2009 | Porter | 70/271 | |
| 2009/0249846 | A1 * | 10/2009 | Gokcebay | 70/279.1 | |
| 2013/0139561 | A1 * | 6/2013 | Parto et al. | 70/278.7 | |

* cited by examiner

*Primary Examiner* — Lloyd Gall
(74) *Attorney, Agent, or Firm* — Plager Schack LLP

(57) ABSTRACT

A wirelessly-actuated, wall-mountable, deadbolt system for securing the locking of a door or window is provided that includes an actuator housing for storing therein at least a part of a electronically-controlled deadbolt actuator operable from a remote controller to direct reciprocal axial movement of a deadbolt, a deadbolt mechanically linked to the electronically-controlled actuator to move reciprocally upon actuation into and out of engagement with an opening in a side surface of the door or window; and a programmable controller to control actuation of the actuator and, thus, the deadbolt.

2 Claims, 22 Drawing Sheets

WIRELESS-ACTUATED WALL-MOUNTED DEADBOLT SYSTEM

RELATED APPLICATION

The present application claims priority from provisional application Ser. No. 61/878,231 filed Sep. 16, 2013, the entire contents of which are incorporated herein in its entirety by reference.

BACKGROUND

The embodiments herein relate generally to lock assemblies for automatically controlling the locking and unlocking of doors or windows, and in particular, wirelessly-operable assemblies for local and remote operation.

SUMMARY

Wirelessly-actuated, wall-mountable, deadbolt systems are provided for securing the locking of a door or window, where at least some of the systems are configured to remain in place even when the door or window to be locked is exchanged for another door or window without either (a) replacing any existing deadbolt system on the door or window, or (b) adding a deadbolt system to the door or window, thereby providing longer term usage of the system and more flexibility over systems in which the automated deadbolt system resides entirely within the door or window itself. In some embodiments, the system comprises an actuator housing for storing at least a part of an electronically-controlled deadbolt actuator therein, the actuator being operable from a remote controller to direct reciprocal axial movement of a deadbolt within the housing upon remote actuation, the housing being configured to reside within a wall proximate a door to be locked; a deadbolt mechanically linked to the electronically-controlled actuator to move reciprocally upon actuation into and out of engagement with an opening in a side surface of the door or window; and a controller configured to be programmable to permit control of actuation of the electronically-controlled actuator and, thus, the deadbolt, the controller being electronically linked with the deadbolt actuator and configured to be mounted within the wall, the controller configured for manual and automated operation; wherein the system may be mounted within the wall such that a user may lock and unlock the door or window via actuation of the deadbolt into and out of engagement with the door or window, respectively, either by manual operation or through wireless communication with the controller.

In some embodiments, the deadbolt actuator comprises a solenoid, which solenoid may be of either a normally-closed or a normally-opened type, the solenoid configured to open or close based upon electronic communication with the controller by the user. In some embodiments, the controller is configured so that manual operation may be provided by way of a programmable keypad configured to activate the controller upon the input of the associated keypad code. In the same or other embodiments, the controller is configured so that manual operation may also be provided by way of a keyway into which a key may inserted to manually actuate the control to lock and unlock the door. In such embodiments, or in other embodiments, the controller is configured to wirelessly communicate with a Bluetooth device. Preferably, although not necessarily, the system comprises a software application downloadable to a user's portable consumer electronic device to permit remote wireless communication with the controller for deadbolt actuation.

In some embodiments, a wirelessly-actuated, wall-mountable, deadbolt system is provided for securing the locking of a door that has a door latch, where the system comprises, in some cases, an actuator housing for storing at least a part of an electronically-controlled deadbolt actuator therein, the actuator being operable from a remote controller to direct reciprocal axial movement of a deadbolt within the housing upon remote actuation, the housing being configured to reside within a wall proximate a door to be locked; a deadbolt mechanically linked to the electronically-controlled actuator to move reciprocally upon actuation into and out of engagement with an opening in a side surface of the door or window; a lock latch connected to the deadbolt and configured to move linearly relative to the deadbolt as the deadbolt is moved via the actuator, the lock latch being configured to permit the control of a door latch system that is lockable via a latch lock, and a controller configured to be programmable to permit control of actuation of the electronically-controlled actuator and, thus, the deadbolt, the controller being electronically linked with the deadbolt actuator and configured to be mounted within the wall, the controller configured for manual and automated operation; wherein the system may be mounted within the wall such that a user may lock and unlock the door or window via actuation of the deadbolt into and out of engagement with the door or window, respectively, either by manual operation or through wireless communication with the controller. In some embodiments, the system further comprises a cam and a stop each configured to control the linear position of the lock latch relative to the deadbolt during actuation of the deadbolt.

BRIEF DESCRIPTION OF THE FIGURES

The detailed description of some embodiments of the invention will be made below with reference to the accompanying figures, wherein like numerals represent corresponding parts of the figures.

DETAILED DESCRIPTION OF CERTAIN EMBODIMENTS

By way of context, embodiments of the present system comprise a safe and secure, wirelessly-actuated, in-wall-mountable, dead bolt system for securing the locking or unlocking of a door or window operated remotely via keypad, smartphone, tablet or key fobs without the need to either a) replace any existing deadbolt or hardware on the door or, b) eliminate the need to re-key locks, or c) add a deadbolt system to the door. Embodiments of the present invention offer advantages over current automated deadbolt systems and existing locks that reside on the door itself. For one, it permits simpler installation in that existing hardware stays intact and certain embodiments require only extending and/or deepening the hole in the door frame. Another advantage is that certain embodiments provide greater security as such systems are configured to extend through the door jam and studs, as compared to existing locks that only penetrate the door casing, thereby providing a more secure system requiring greater force to break down the door. Yet another advantage with some embodiments is the elimination of the need to replace batteries as such systems can be hard-wired into the existing home electrical system. And other advantages include a discrete locking system that may be hidden entirely within the door frame or wall, or may be integrated directly into the molding instead of the large unsightly devices mounted on the interior side of the door.

Figure 1:
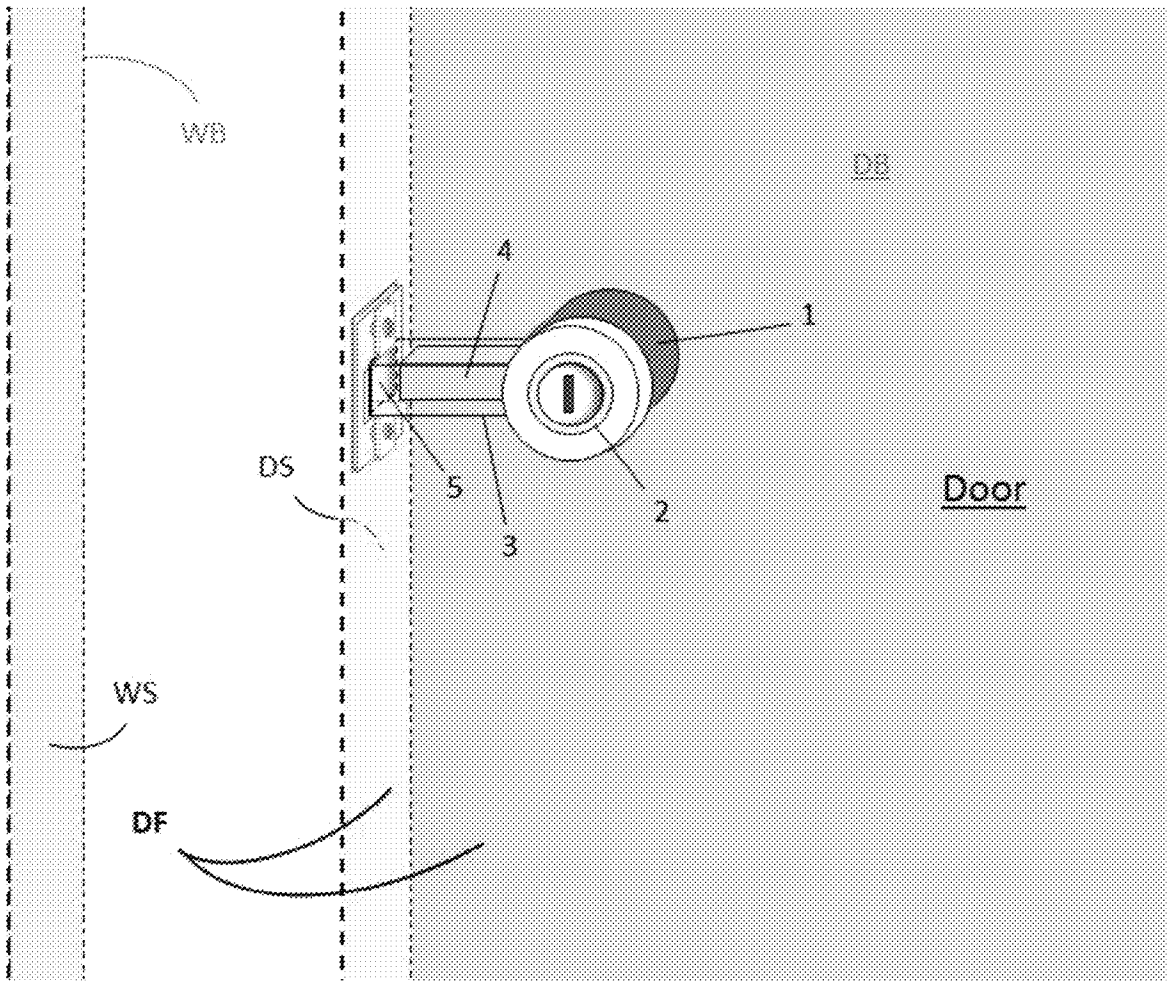
FIG. 1 shows a schematic perspective view of one application of embodiments of the present invention.

Referring to FIG. 1, context for certain embodiments of the present invention may be provided, where an existing Door and Wall include a deadbolt 1 within the Door, where the Door comprises a door front (exterior) surface DF as viewed from the exterior of the wall, as well as a door back (interior) surface DB and a door side surface DS. Similarly, the Wall has a wall front surface WF as viewed from the exterior of the wall, as well as a wall back surface WB and a wall side surface WS. The deadbolt 1, by way of example, may comprise a means for locking and unlocking the deadbolt from the exterior of the door, such as a keyway 2, a passageway 3 within the door for lateral movement of a bolt or latch 4 through a latch plate 5 on the door side surface DS. As described below, the opening in the Wall into (and out of) which the latch 4 may move may vary depending upon the embodiment of the present invention employed.

Figure 2A:
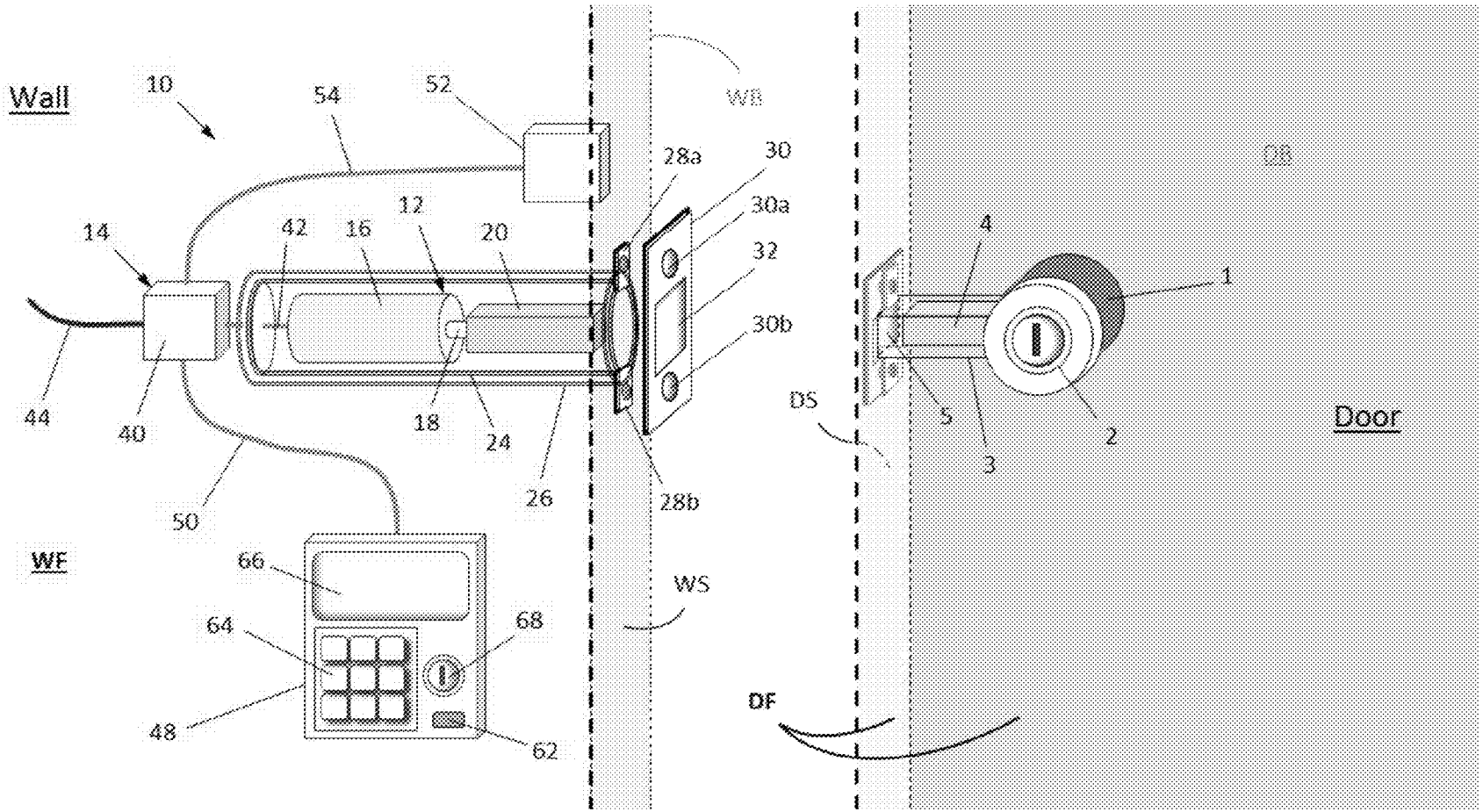
FIGS. 2A and 2B show schematic perspective views of one embodiment of the present invention as applied to the circumstances shown in FIG. 1, where the embodiment is in a first and second position, respectively, where the view is from the outside of the door and wall.
Figure 2B:
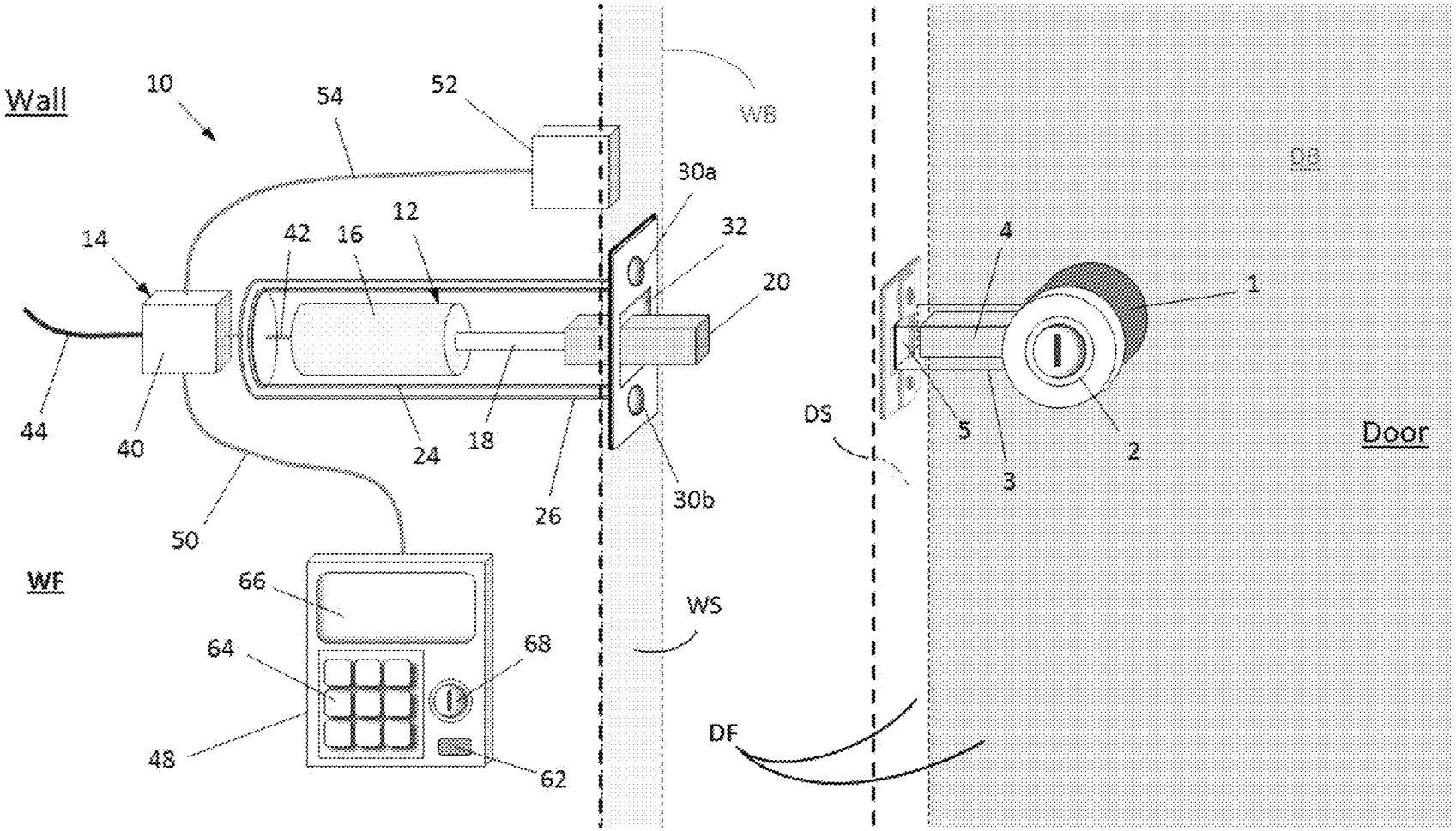

By way of example, and referring to FIGS. 2A and 2B, one embodiment 10 of the present invention comprises an actuator 12 and a controller 14 for operating the actuator 12 as controlled by the user. For ease of visualization of details, the Wall and Door have been shown spaced from each other more than would exist naturally, permitting clearer viewing of the wall side surface WS.

Figure 13:
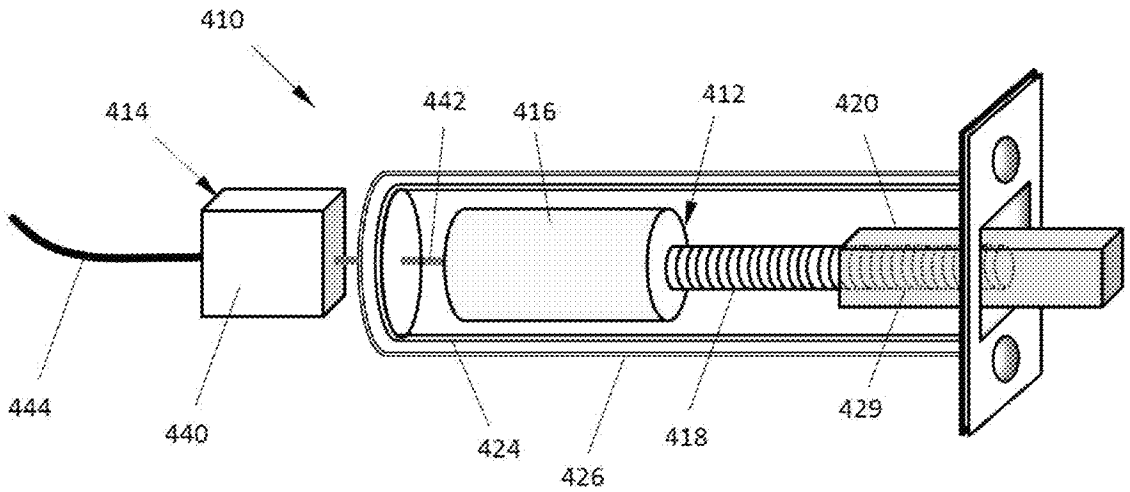
FIG. 13 shows a schematic perspective view of an embodiment of the present invention.

The actuator 12 may comprise an electronic solenoid 16 comprising a shaft 18 axially positioned therein and connected to a bolt 20 so that when the shaft 18 is directed to move laterally in one direction or the other, the bolt 20 moves with the shaft 18. The solenoid 16 may be of a normally-open or normally-closed type, and may comprise any type of component in which either electrical power or the cessation of electrical power triggers lateral movement of the shaft 18 within the solenoid 16. For example, an alternative system is shown in FIG. 13 and described below.

The actuator is preferably housed within an actuator housing 24 secured within an opening provided in the Wall through the wall side surface WS in a manner not unlike that utilized in placement of a traditional dead-bolt assembly within a wall or a door. The actuator housing 24 may comprise end tabs 28*a* and 28*b* that may be covered by a cover plate 30 having corresponding mechanical fastening holes 30*a* and 30*b* for securing the cover plate 30 and the actuator housing (by way of end tabs 28*a*, 28*b*) to the wall side surface. Cover plate 30 comprises a bolt opening 32 for permitting the bolt 20 to extend through the cover plate 30 when actuated. Comparing FIGS. 2A and 2B, one may appreciate operation of the actuator 12 in moving between a first position shown in FIG. 2A and a second position shown in FIG. 2B. In the former, the bolt 20 remains entirely within the actuator housing 24, where in the latter, the bolt 20 has been directed outwardly through opening 32 in the cover plate 30.

In one embodiment, the controller 14 of system 10 comprises an electronic control system 40 configured to direct low voltage power to solenoid 16 via cable 42, where in some examples the control system 40 may be powered through existing power source 44 provided in the Wall. It is also contemplated that the control system 40 be independently powered, such as with rechargeable batteries or the like. It should also be noted that the solenoid may be battery powered, where control of the battery-powered solenoid may be provided wirelessly, via BlueTooth® for example, from a user's computerized device, such as a smart phone. In such a case, the control system 40 may be situated within the actuator housing 24.

The control system 40 may be user-controlled via an exterior control box 48 connected electronically to control system 40 via cable 50, or wirelessly. The control box 48 is preferably mounted on the front (exterior) wall surface WF; in other words, presented from the exterior of the building. Preferably, the control system 40 is also user-controlled via an interior control button (not shown) housed within control box 52 mounted on the back (interior) wall surface WB and connected electronically to control system 40 via cable 54 or wirelessly, where the button is mounted visibly from the interior of the building. Having a dual-control assembly permits actuation of the system 10 from within and without the building in which the Wall resides, or from one side or the other if the Door is an interior door, as explained below.

In one embodiment of the exterior user control box 48, a detector 62 may be provided for wireless detection of a remote activation device (not shown), which may be one of numerous devices capable of transmitting a signal wirelessly to the user control box 48 to activate system 10. For example, the device may comprise a smart phone that includes a downloadable app designed to interface with embodiments of the present invention where a blue-tooth signal may be transmitted to trigger system activation. Numerous other devices may be employed where a user may remotely control operation of the system embodiments by sending a wireless signal to trigger actuation of the actuator, alternating between a first and second position of the bolt 20 within actuator housing 24.

If desired, the user control box 48 may also comprise manual controls, such as a key pad 64 for permitting local actuation and control by the user. The key pad 64 is preferably programmable to permit a user to select from one of a number of possible alphanumeric or numeric codes to trigger actuation. A display 66 may preferably be provided showing the status of the system. If further desired, a manual override may be provided in the form of a key 68 to permit manual operation of the bolt 20 between a first and second position. It should also be noted that some embodiments may not employ a control box 48 at all, permitting purely wireless remote operation of the control system 14 mounted within the Wall. Thus, not only is the control box 48 optional, but even where a control box 48 is employed, one or more features of operation are optional as well.

It is intended by at least some embodiments of the present invention that when the deadbolt of a door has been set to a locked position, the latch 4 of deadbolt 1 is positioned so that the latch 4 extends through latch opening 5 and into a receiving opening of the present invention embodiments, such as actuator housing 24 of embodiment 10, thus creating a locked position for the deadbolt. Actuation of bolt 20 between a first and second position thereby forces latch 4 back out of the actuator housing 24 so that the deadbolt 1 is returned to an unlocked position. With some deadbolt locks, full extension of the deadbolt trips a cam that prevents the deadbolt from being withdrawn into Door opening 3 unless unlocked manually by key or other conventional means. In such cases, the deadbolt 4 may need to be positioned such that it is in a locked position, but not fully extended into the actuator housing 24 whereby the deadbolt cannot be pushed out of the actuator housing by the bolt 20.

Depending upon the particular design of embodiment, the second position of the bolt 20 may be such that it is a momentary position sufficient to return the deadbolt 1 to an unlocked position, where then the bolt 20 returns to the first position entirely within the actuator housing 24. In other embodiments, the second position of bolt 20 is such that it may remain just outside the opening 32 of cover plate 30 so that opening and closing of the door is permitted while the bolt 20 remains in the second position. Nuances of such bolt 20 operation may vary from embodiment to embodiment as desired by the manufacturer to accommodate one of numerous possible wall-door contexts.

Figure 3A:
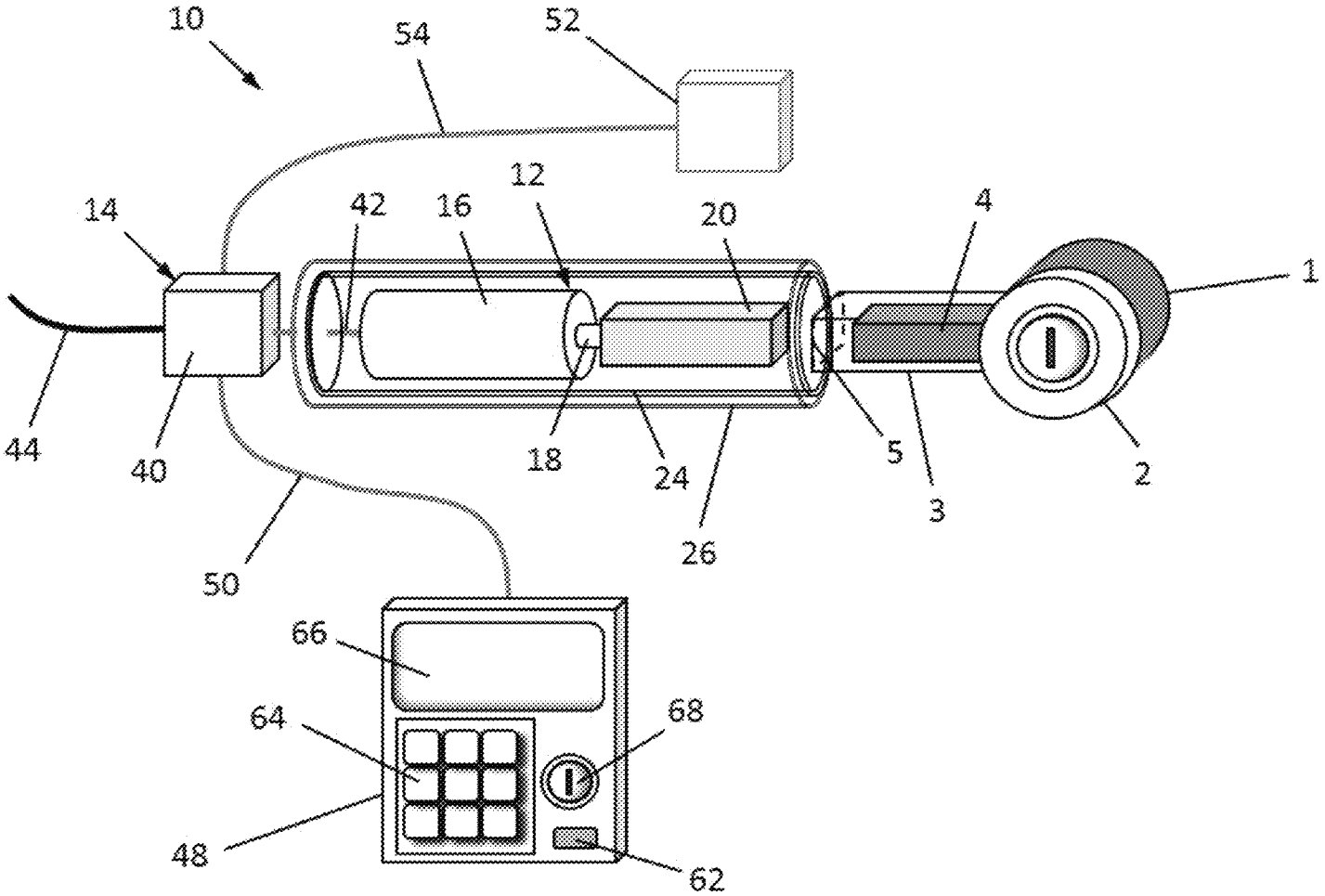
FIGS. 3A and 3B show schematic perspective views of the embodiment of FIGS. 2A and 2B, where the existing deadbolt is shown in an unlocked and locked position, respectively.
Figure 3B:
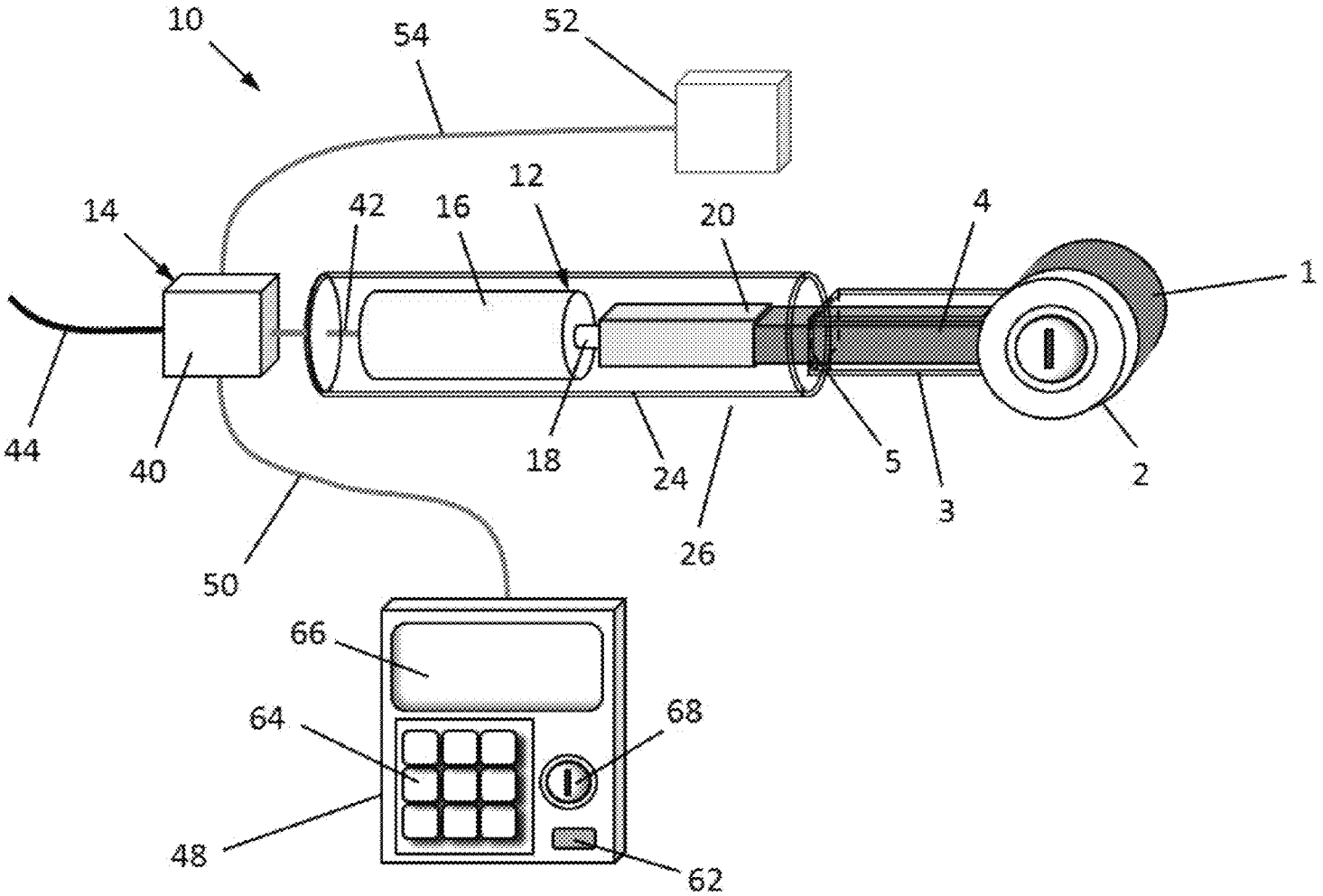
Figure 4A:
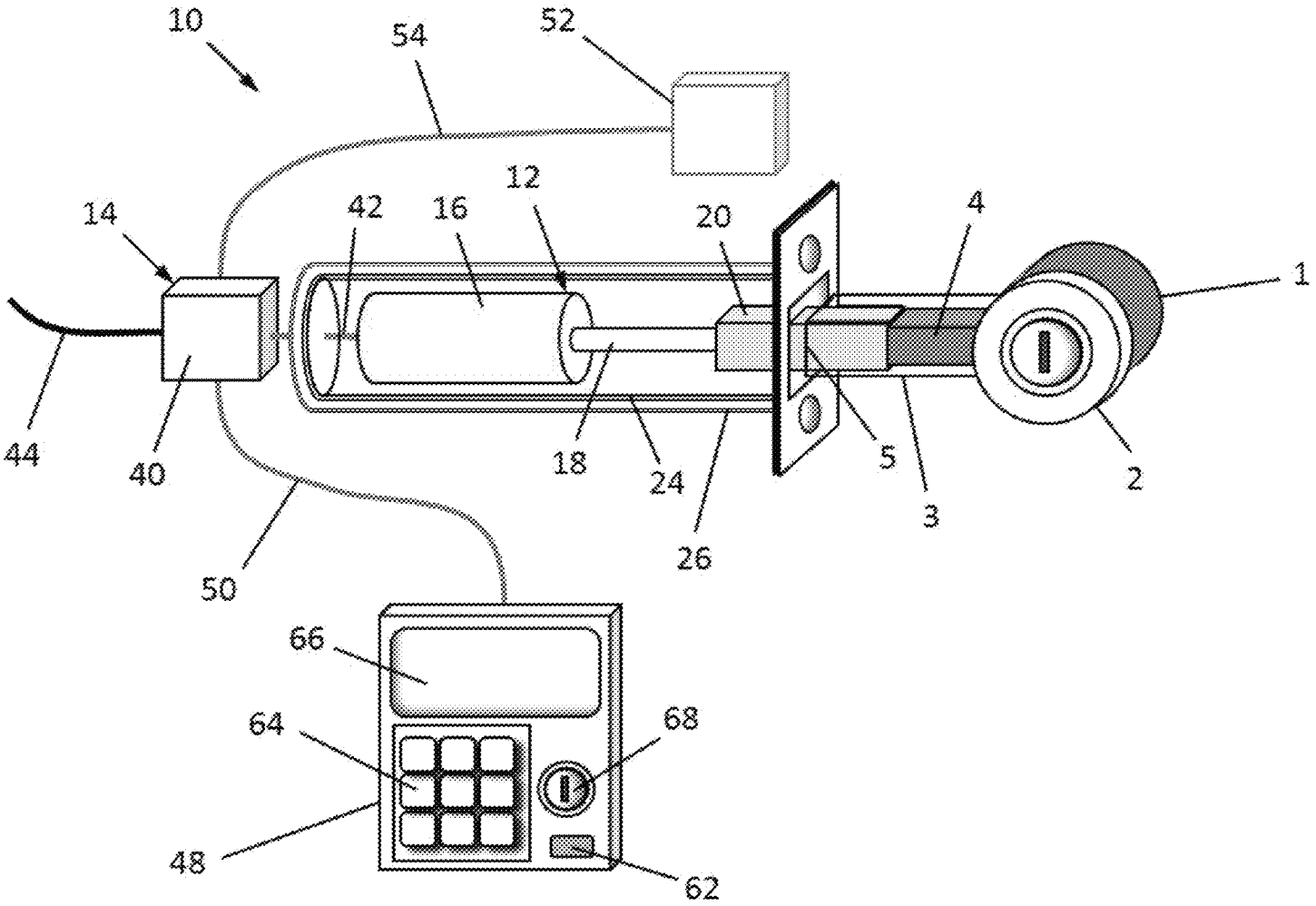
FIGS. 4A and 4B show schematic perspective views of the embodiment of FIGS. 2A and 2B, where the embodiment is in a first and second position, respectively, as applied to the existing deadbolt in a locked and unlocked position, respectively.
Figure 4B:
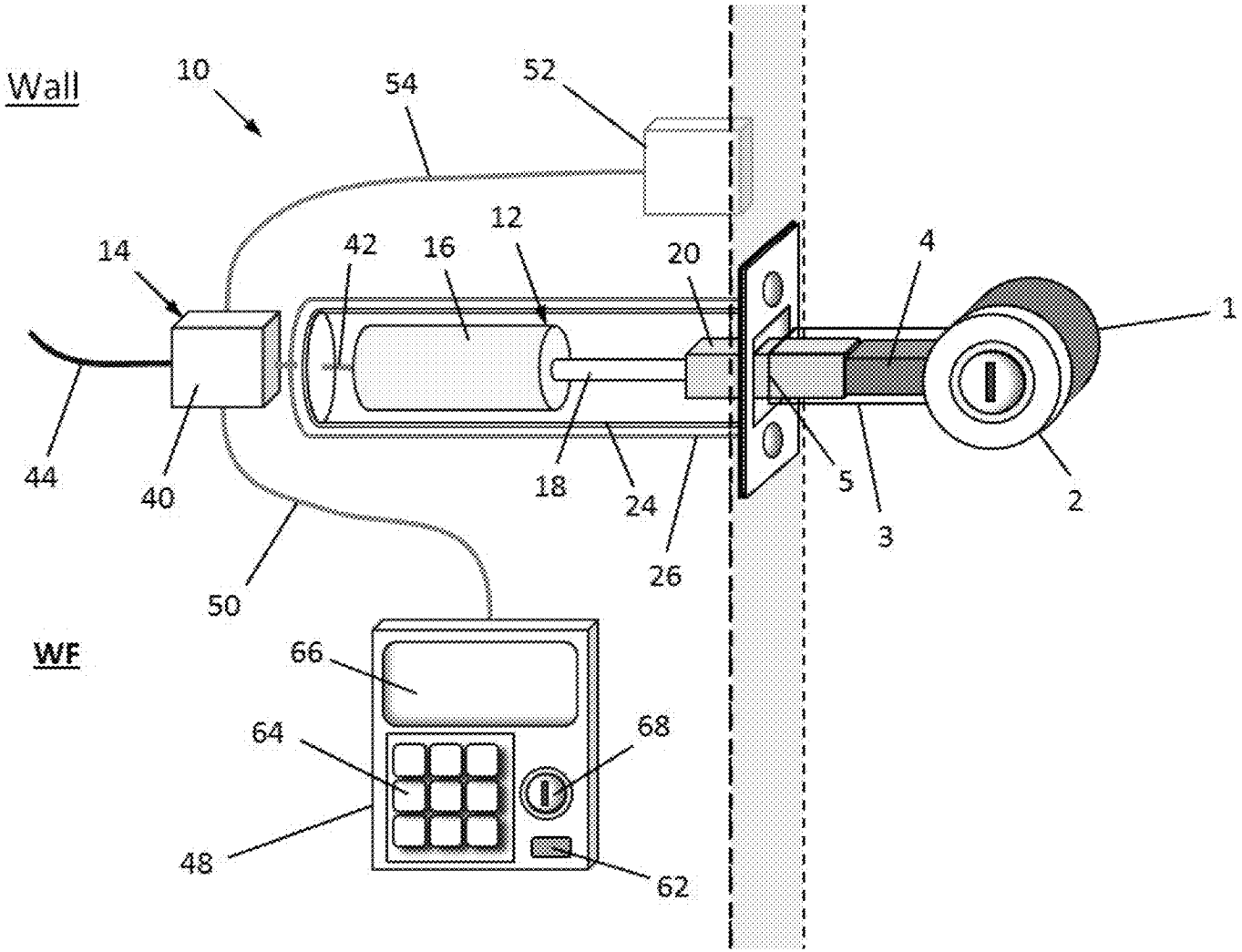
Figure 5A:
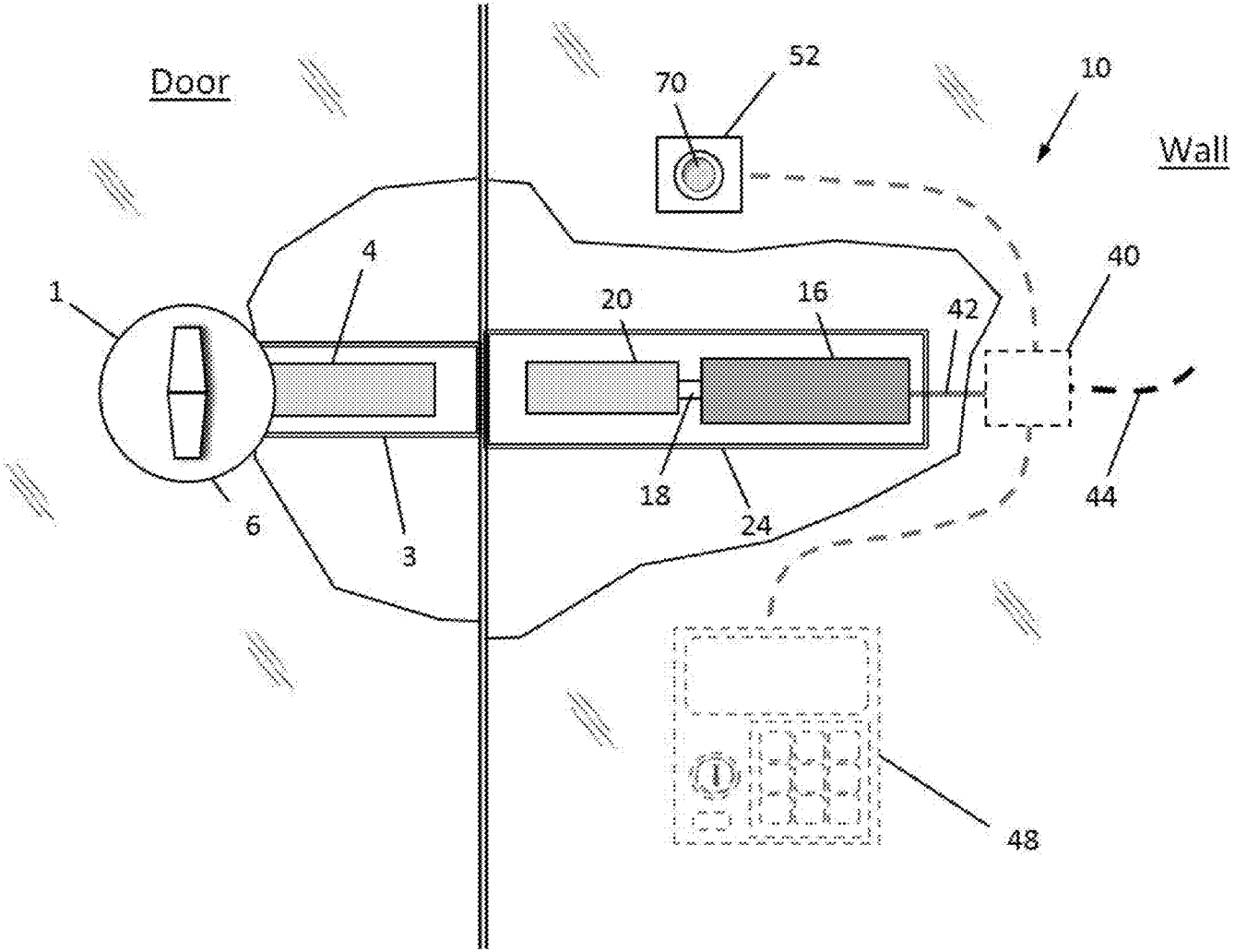
FIGS. 5A, 5B and 5C show schematic elevational views of the embodiment of FIGS. 2A and 2B shown from the interior of the wall and door, where the existing deadbolt is in a locked (FIG. 5A) and (FIG. 5B) unlocked position while the embodiment is in a first position, and then the embodiment is in a second position (FIG. 5C), respectively.
Figure 5B:
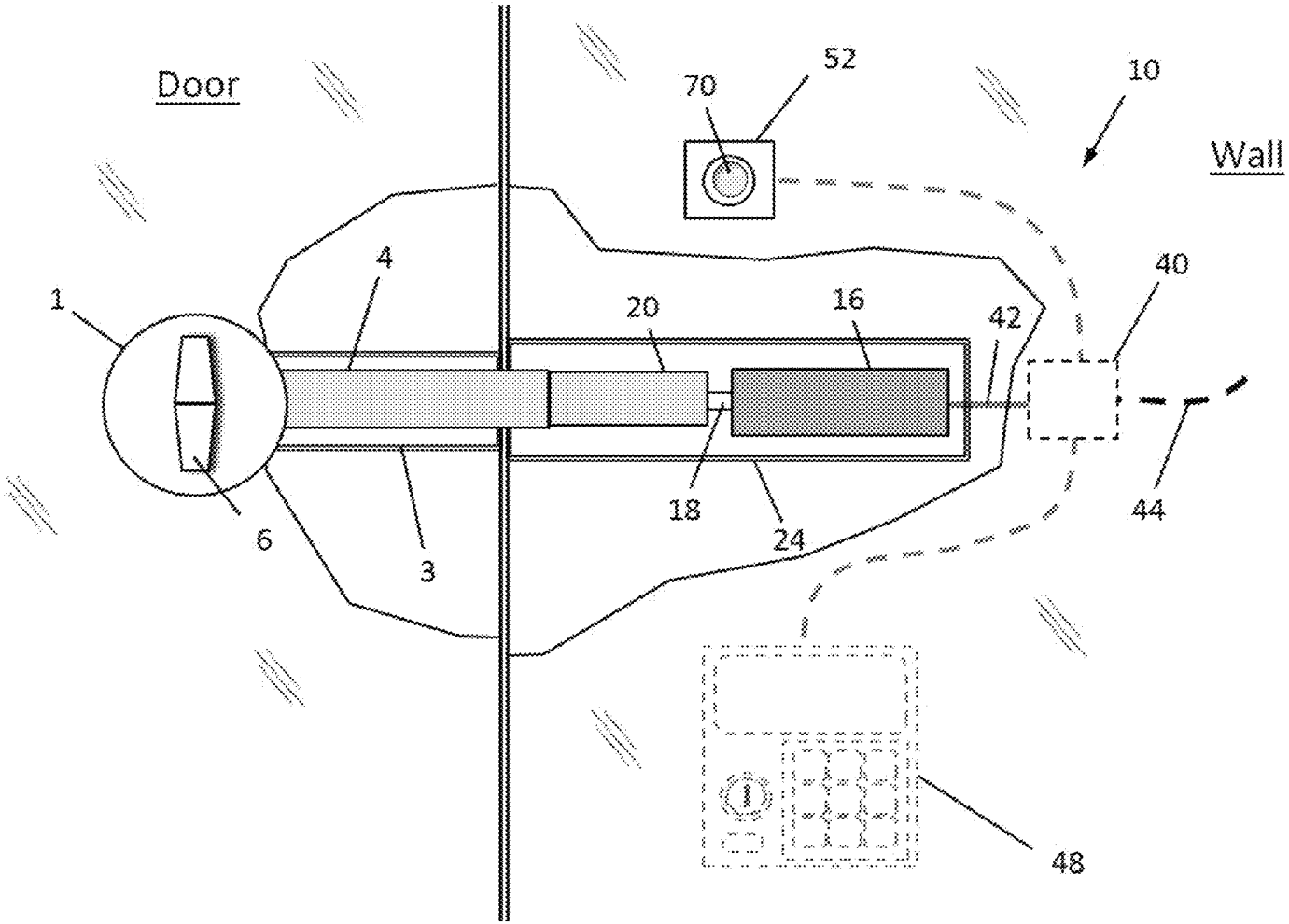
Figure 5C:
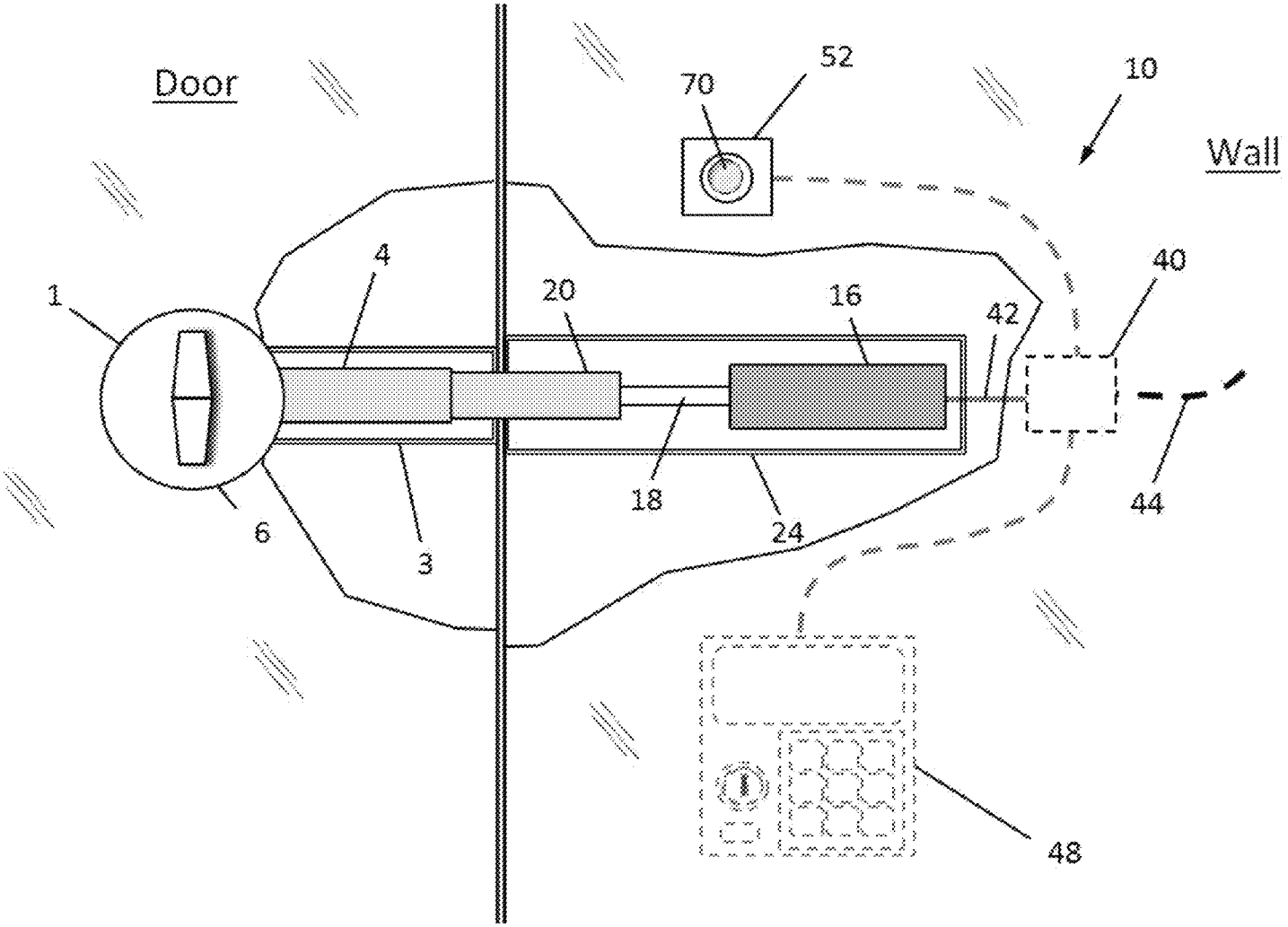

In that regard, reference to FIG. 3A shows, by example, embodiment 10 where the bolt 20 is in a first position and the deadbolt 1 is in an unlocked position with the latch 4 within the passage 3. In FIG. 3B, the deadbolt 1 has been placed into a locked position, where the latch 4 extends into, for example, the actuator housing 24 of embodiment 10. Referring to FIGS. 4A and 4B, the system 10 may be actuated so that the bolt 20 moves to the second position to unlock the deadbolt 1 by pushing latch 4 back entirely within passage 3. FIG. 4B simply shows the arrangement of FIG. 4A in the context of the Wall for ease of reference. Viewing the same sequence of operation from within the interior of the building, reference is made to FIGS. 5A through 5B, where the deadbolt 1 is manually operable by thumb turn 6 while the system embodiment 10 may be operable manually by button 70 housed within control box 52.

Figure 6:
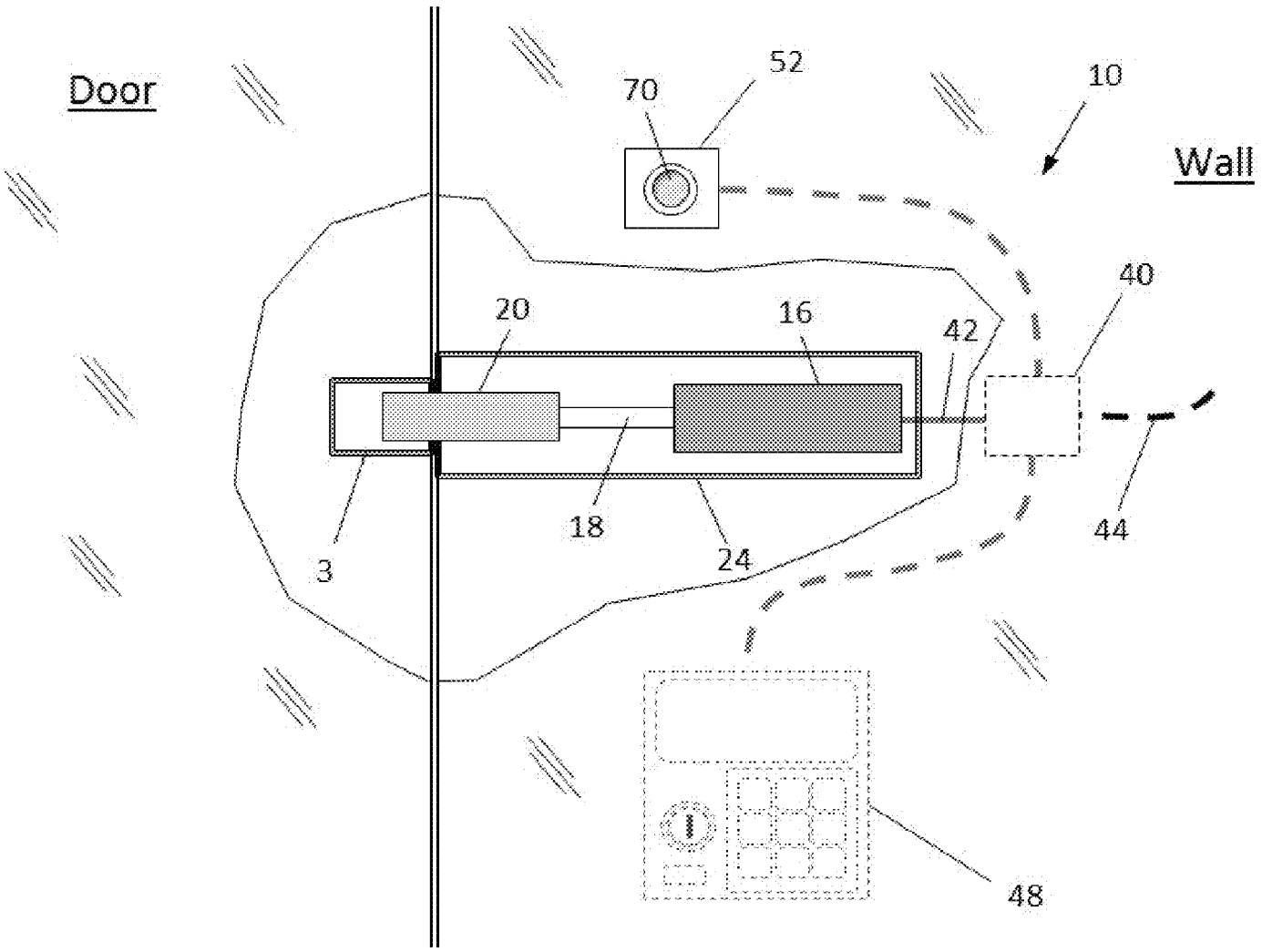
FIG. 6 shows a schematic elevational view of an embodiment of the present invention shown in a different application from the interior of the wall and door.

Referring to FIG. 6, embodiments of the system may be employed where no door deadbolt exists. For example, if may be desired to employ the system 10 in a wall adjacent a door that has no deadbolt where a user may simply create a passage 3 within the side wall of the Door to permit the bolt 20 of system 10 to extend into the passage 3 to lock the door in a closed position. The passage 3 may also exist in certain doors, and the system 10 may be installed such that the actuator housing 24 is aligned with passage 3 for effective operation.

Figure 7:
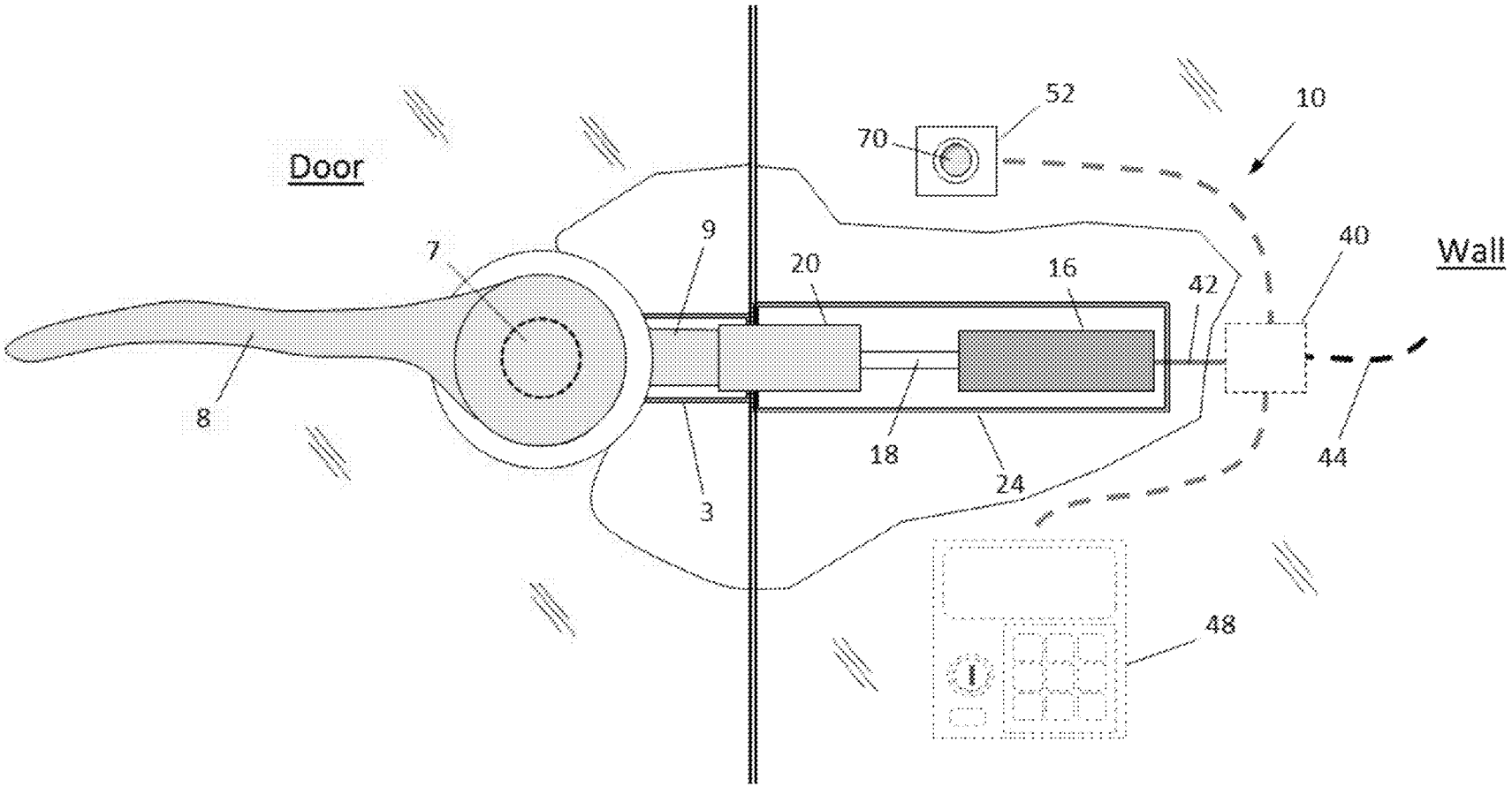
FIG. 7 shows a schematic elevational view of an embodiment of the present invention shown in a different application from the interior of the wall and door.
Figure 8A:
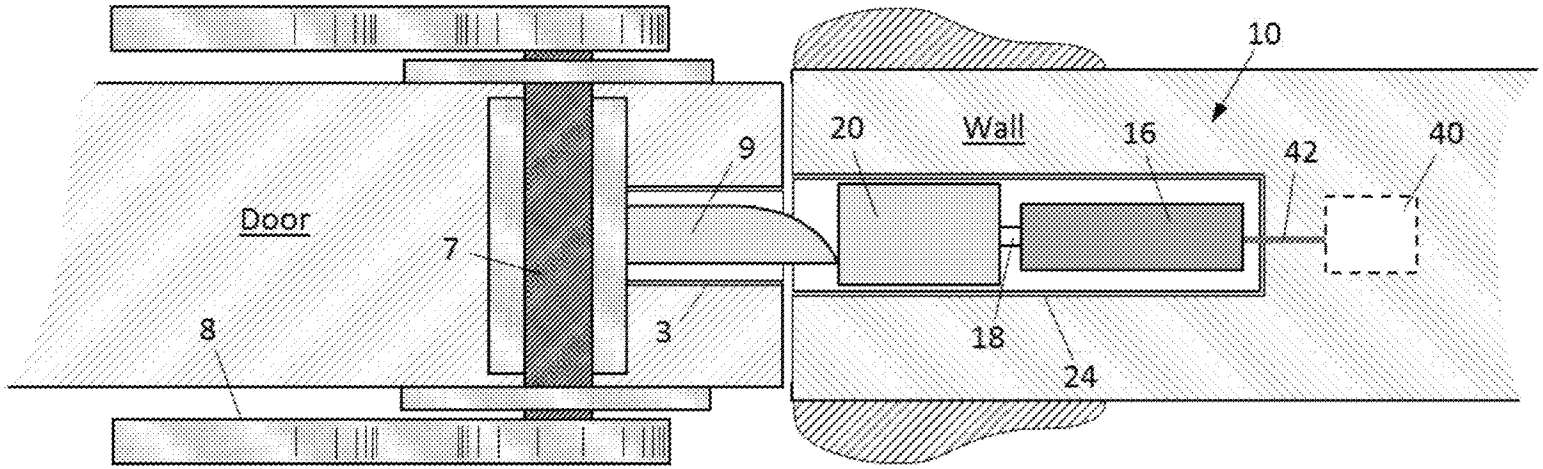
FIGS. 8A and 8B show schematic top views of the embodiment of FIG. 7, where the embodiment is in a first and second position, respectively, as applied to an existing door handle in a closed and open position, respectively.
Figure 8B:
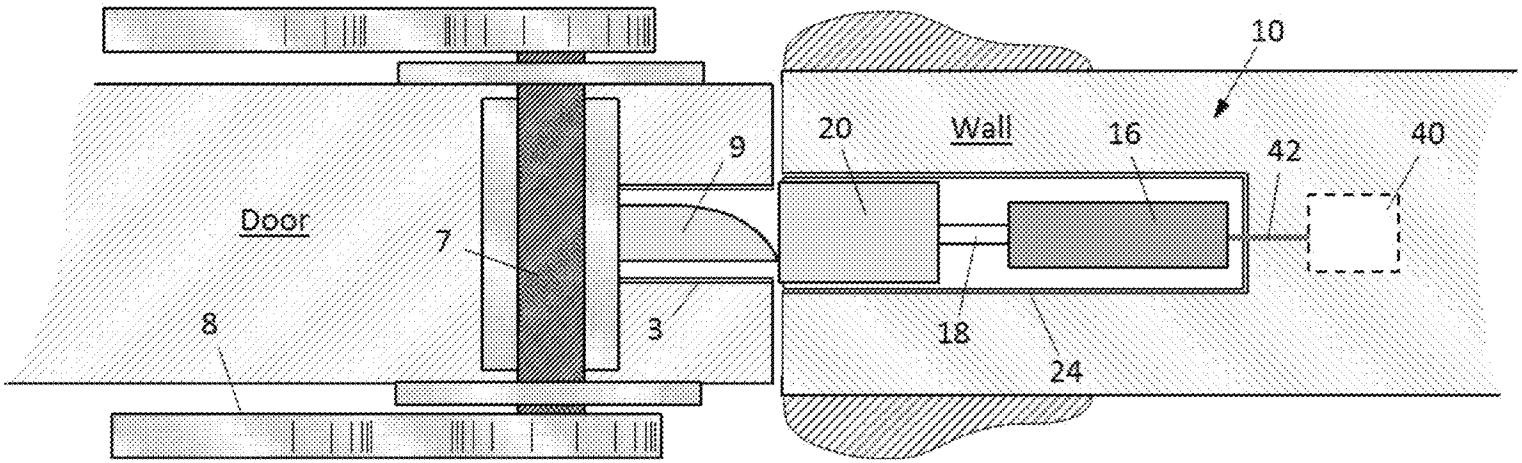

It is also contemplated that embodiments of the present invention may be employed for operation with traditional door handles that may or may not lock a door in the closed position but simply permit a user to open the door or secure the door in a closed position. In that regard, referring to FIG. 7, an embodiment of the present invention may be employed with a door handle system in which a cylinder 7 supports a handle 8 for controlling the lateral movement of a latch 9 within a passage 3. Referring to FIGS. 8A and 8B, a top view of the arrangement may be appreciated where it can be seen that the latch 9 has a tapered end as is often found with traditional door handle systems for interior doors. In that regard, FIG. 8A shows the Door in a closed position where the latch 9 extends into actuator housing 24 of embodiment example 10, and the bolt 20 is in a first position also within the actuator housing 24. Upon actuation of the system 10, the bolt 20 may be moved via actuation of the actuator 16 to a second position to push the latch 9 of the actuator housing permitting the user to open the door. A door lock may not be employed in this example of an interior door handle, so the inventive embodiment 10 is not being used to lock and unlock the door so much as to permit opening and closing of the door without need of turning the handle. In some situations, where a door includes spring-hinges configured to be biased in a normally door-open position, actuation of the inventive system would trigger the door to be unlatched so that it would then swing open automatically. Alternatively, the door spring-hinges may be biased in a normally-closed position but the inventive system is actuated to permit the user to simply push or pull on the door handle (depending upon whether the user is on one side or the other of the door) to open the door without having to unlatch the door by turning the door handle. In such cases, a stationary knob may be employed on the door rather than a rotatable lever. Nonetheless, for purposes of the embodiment example 10 of FIGS. 7 through 8B, the door includes two rotatable levers 8 to permit the user to control the position of the latch 9 if so desired, but the system 10 is employed to permit some degree of automation.

Figure 9:
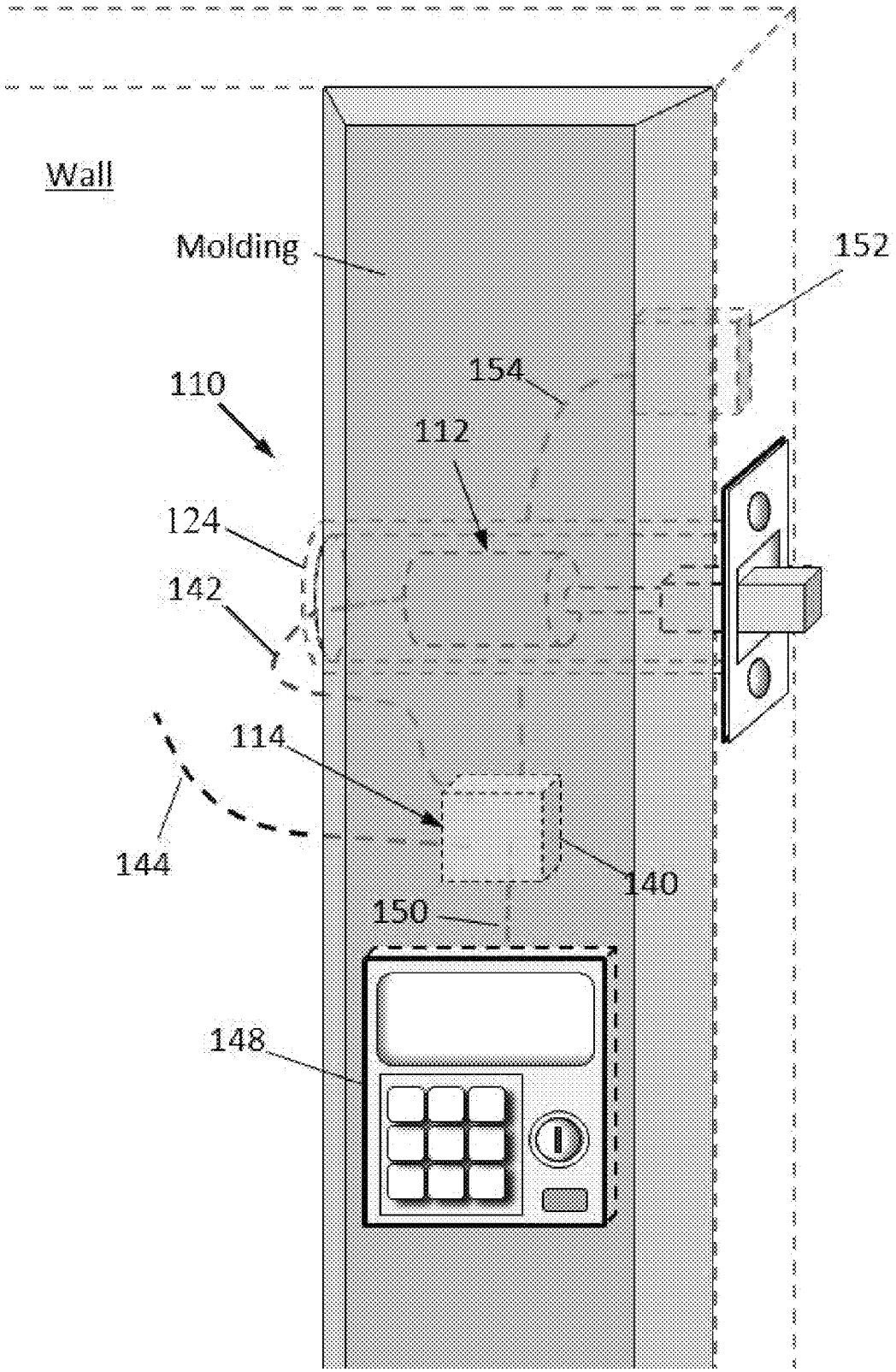
FIG. 9 shows a schematic perspective view of an embodiment of the present invention shown as applied to molding applied to a wall surrounding a door as viewed from the exterior of the wall.

It should be appreciated that embodiments of the present invention may be employed in one of numerous places within a wall or within a door if so desired. In one example of an alternative placement, such as that shown in FIG. 9, an embodiment 110 of the inventive system may be mounted partially within the Molding and partially within the Wall. It should be noted that components of alternative and exemplary embodiments illustrated herein that are the same or similar as other embodiments bear a similar lead number except for the addition of a 1, 2, 3 or 4 in front of the number. For example, actuator housing 124 is similar to actuator housing 24, described above. With regard to the embodiment shown in FIG. 9, a portion of the controller 114 (similar to the controller 14 of FIG. 2A et seq.) may be mounted within the Molding and another portion mounted within the Wall. In the embodiment shown, for example, the external control box 148 may be placed within Molding secured to the Wall adjacent the door in one arrangement, where the balance of the system is mounted within the Wall. In another arrangement, both the user control box 148 and the control system 140 may be mounted within the Molding, with the rest of the system mounted within the Wall. Indeed, although not shown, the entire system may be pre-mounted within a frame work that can be applied to an opening in a wall where the frame work may then be used to secure a door. With such an arrangement, the frame work would be mounted within the interior of a wall opening so that it functioned as the interior wall opening itself, with the door being mounted within the framework so that embodiments of the invention and the door may interengage in ways described and suggested herein with the various inventive embodiments. Again, while the embodiment shown includes an actuator 112 powered via a wire 142 to the controller 114, other embodiments may include a battery powered solenoid where control of the solenoid may be achieved wirelessly by the user from a user-based device.

Figure 10A:
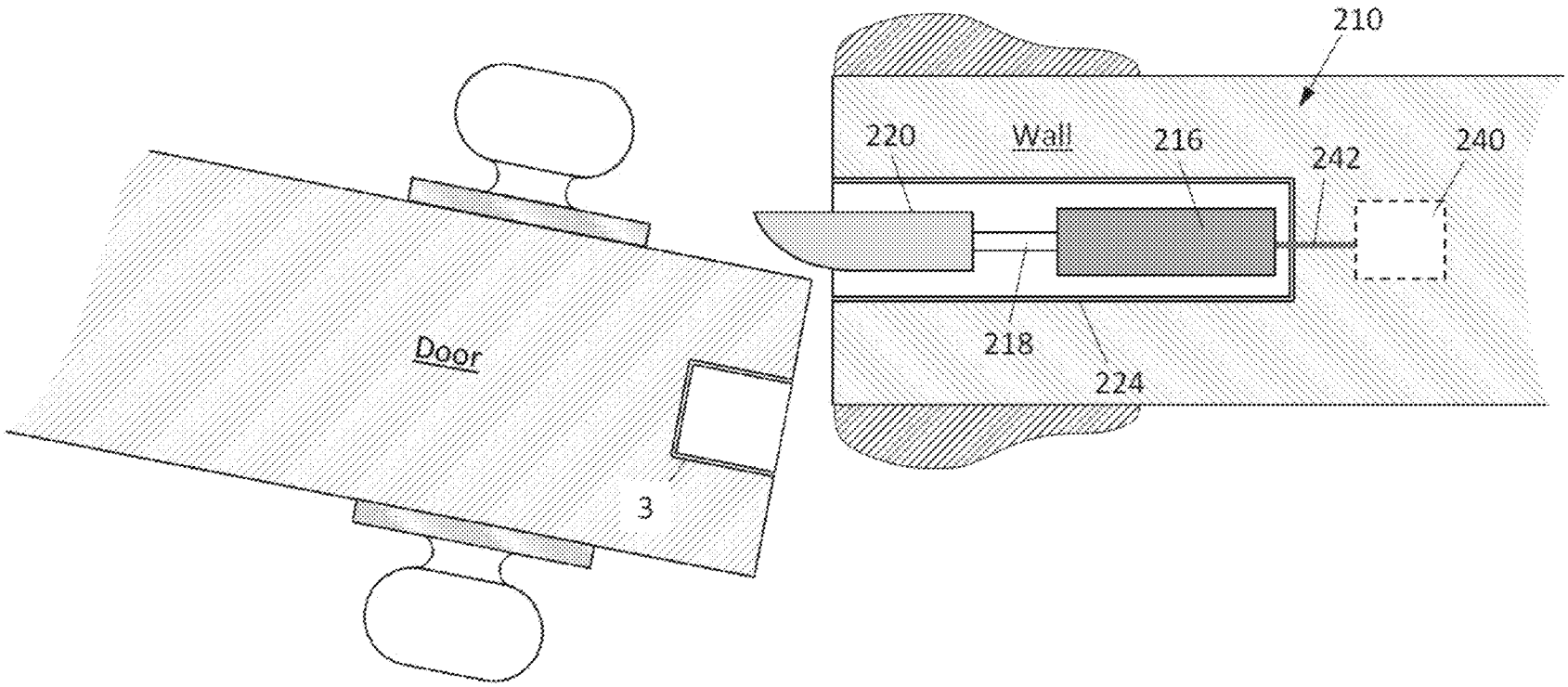
FIGS. 10A through 10C show schematic top views of an embodiment of the present invention shown as applied to a door with simply an opening in the side of the door, but no operating door latch system.
Figure 10B:
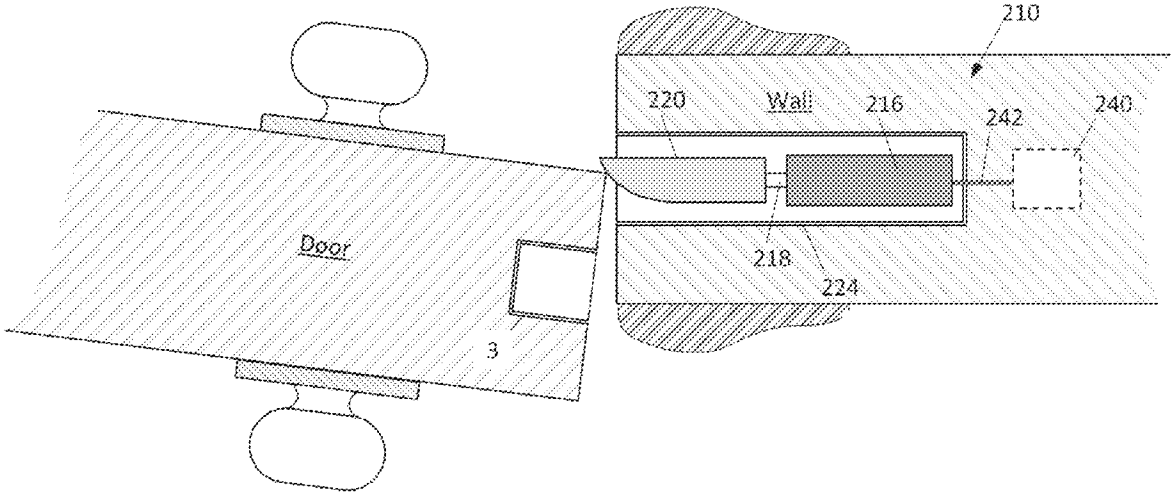
Figure 10C:
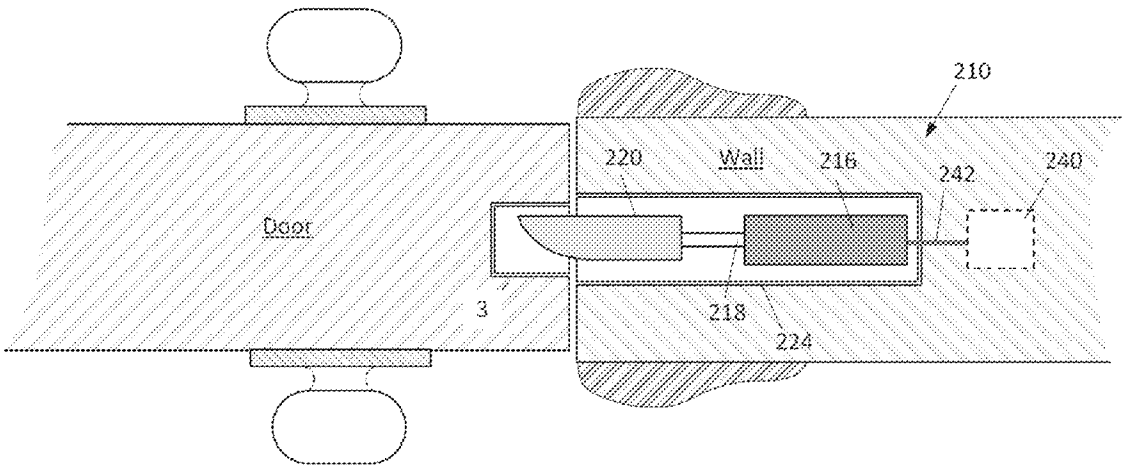

Referring to FIGS. 10A though 10C, an example of another embodiment 210 may be described, where operation of the embodiment is similar to the embodiment examples 10 and 110 above, but where the bolt 220 comprises a tapered end. In such embodiments, the taper resembles that employed on latches used in door latch systems conventionally used on interior doors of building. With such embodiments, where the interior Door comprises only an opening 3 in the side of the door, rather than a door latch system, the invention embodiment 210 functions to permit the lock and release of the interior Door via system actuation described above. The Door may be closed, as shown in the sequence reflected by FIGS. 10A through 10C, where when the Door edge engages the tapered latch 220, the latch 220 is pushed inwardly toward the actuator 216 until the Door is closed flush with the wall, where the actuator 216 is configured to release the latch 220 into opening 3 of the interior Door to secure it in place. To release the Door, actuation of the actuator 216 may be triggered to withdraw the latch 220 into actuator housing 224 so that a user may then push or pull the door open to the position shown in FIG. 10A.

With the embodiment example 210, the tapered latch 220 has a taper on only one side of the latch. Thus, the system 210 is applicable to a door that opens in only one direction; i.e., the direction shown in FIGS. 10A through 10B. In an alternative configuration, the latch may have a double taper, permitting the system to be usable with an interior door that may open in both directions, where the Door when closed (in either direction) causes the tapered latch to be pushed into the actuator housing.

Figure 11A:
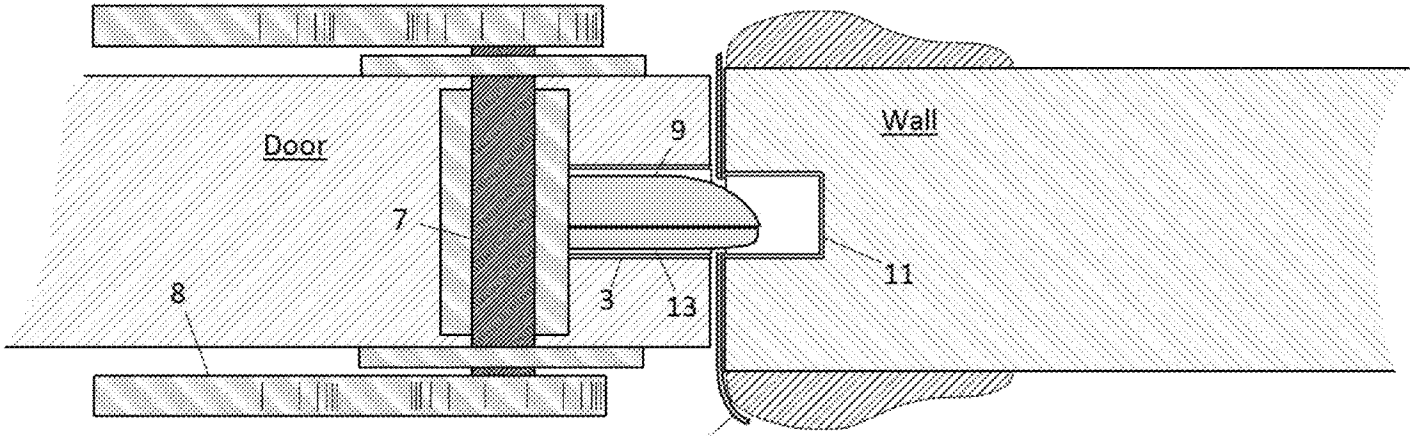
FIGS. 11A through 11D show schematic top views of an embodiment of the present invention shown as applied to a conventional interior door latch system.
Figure 11B:
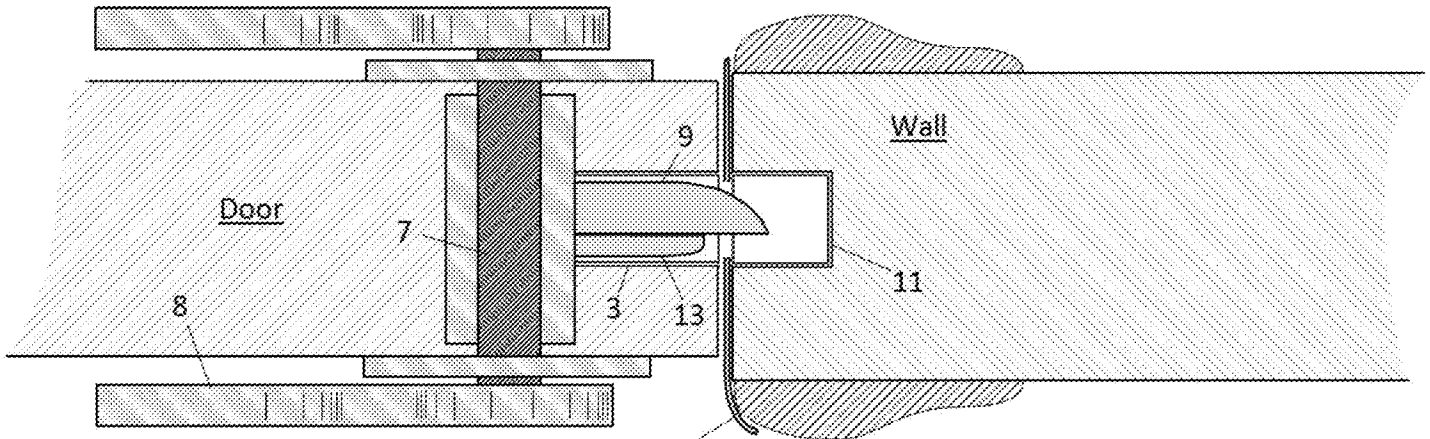
Figure 11C:
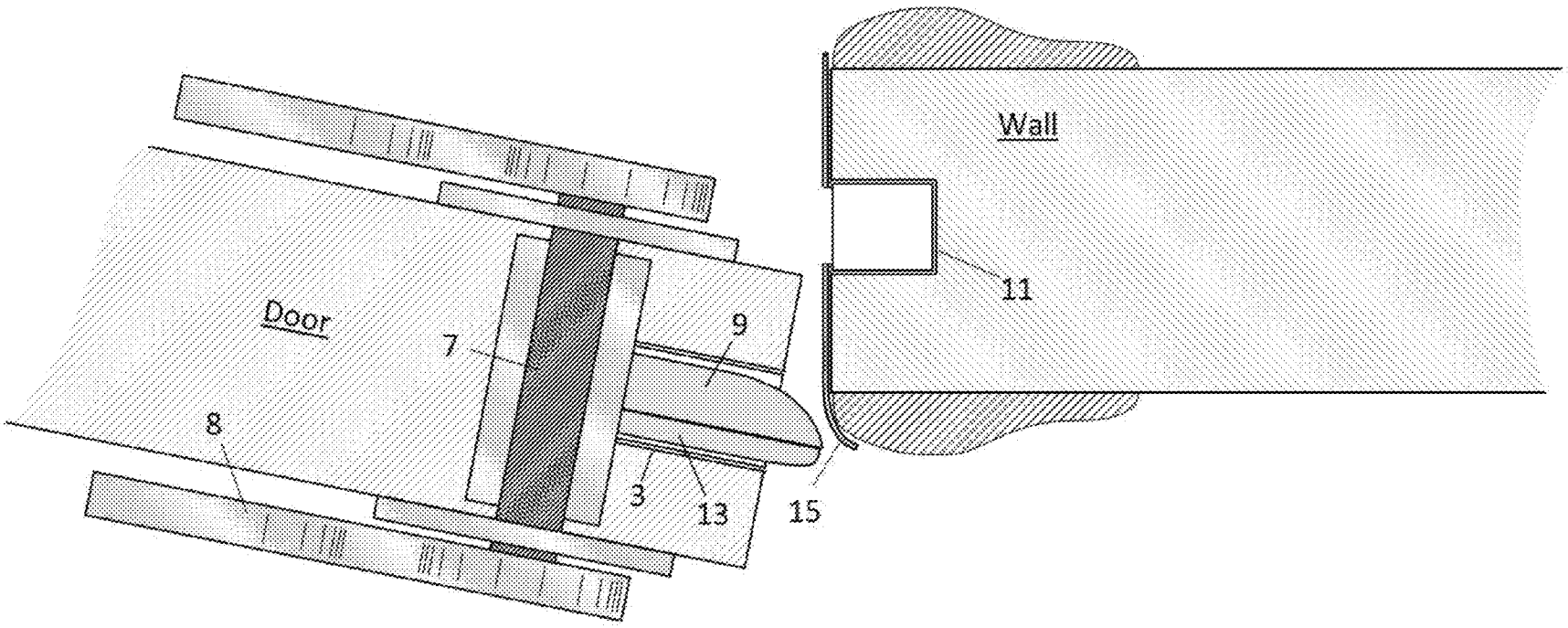
Figure 11D:
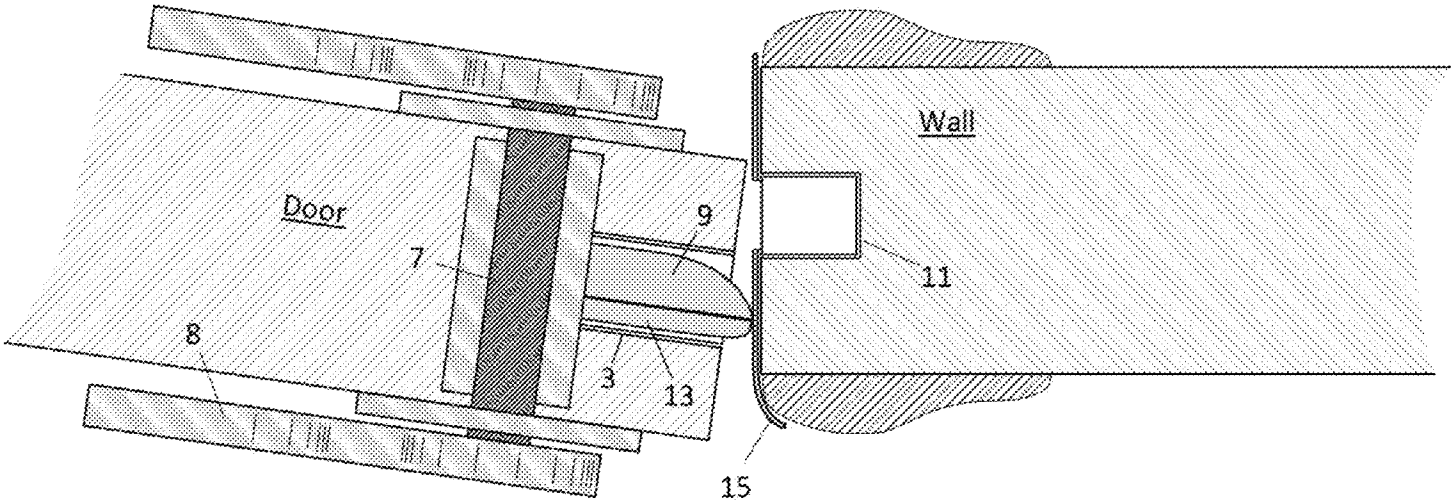

Referring to FIGS. 11A through 11D, one example of an interior door with a locking latch may be explained for context of other embodiments of the invention described below. In that regard, a conventional locking latch system comprises a Door with opening 3 in the side wall where the locking latch system includes a cylinder 7 supporting at least one but in this case two levers 8 (one lever on one side of the Door and another lever on the other side of the Door). The locking latch system of the Door also includes a latch 9 and lock 13. Referring to FIG. 11A, the lock 13 is shown fully extended into opening 11 of the Wall, leaving the latch 9 in an unlocked position, also fully extended into opening 11. In contrast, with the lock 13 in a fully withdrawn position, as shown in FIG. 11B, the latch 9 is in a locked position. In a locked position, the tapered latch 9 cannot move either inwardly or outwardly. If the Door is in a closed position, such as shown in FIG. 11B, the latch system must first be unlocked before the lever(s) can be used to open the Door. When in an unlocked position, the Door may be opened and closed simply by turning one or either of the levers 8. FIGS. 11C and 11D show a sequence of the door closing where the tapered latch 9 engages strike plate 15 to depress the latch within the opening 3 of the Door until both the latch 9 and lock 13 are aligned with wall opening 11 and resume the position shown in FIG. 11A.

Figure 12A:
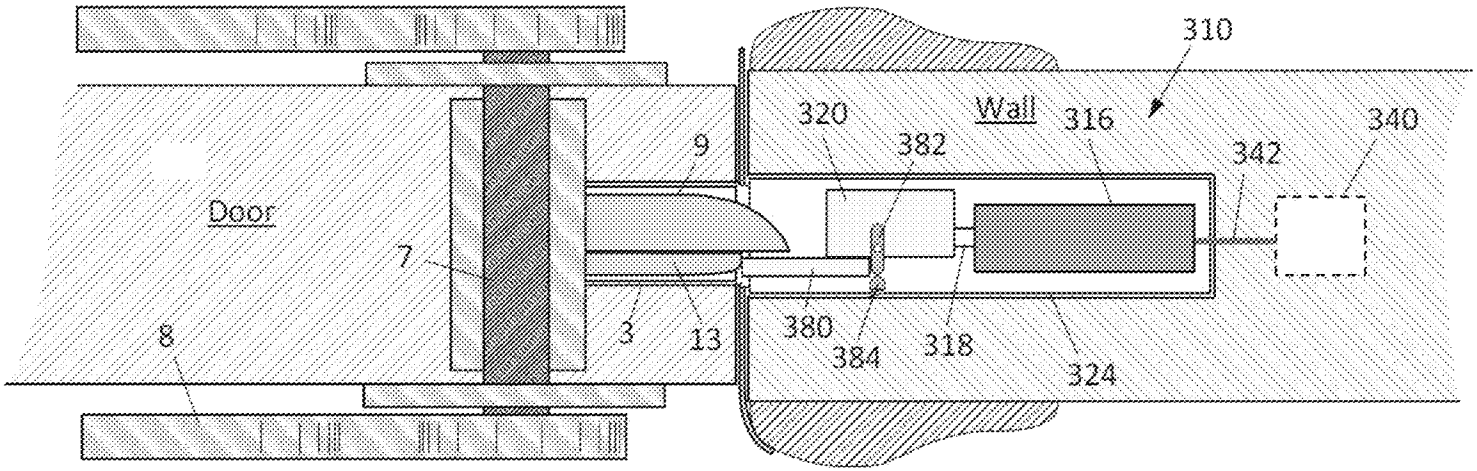
FIGS. 12A through 12F show schematic top views of an embodiment of the present invention shown as applied to the conventional interior door locking latch system, where the inventive embodiment includes one example of a cam feature.
Figure 12B:
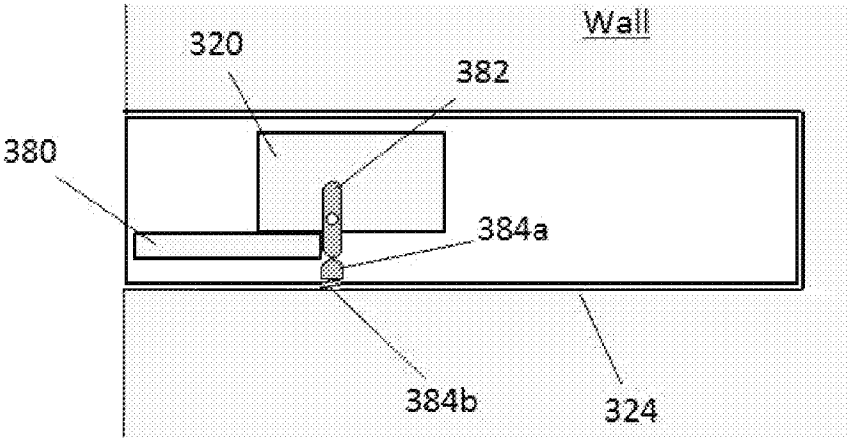

With such a convention locking latch system in mind, reference is now made to FIGS. 12A through 12F in which one example of another embodiment may be applied to such a convention locking latch system, where locking and unlocking of the Door may be automated. In that regard, referring specifically to FIGS. 12A and 12B, embodiment 310 comprises an actuator 316 linked via a shaft 318 to bolt 320, all housed within an actuator housing 324. Movably secured to the bolt 320 is a lock latch 380 that may be mechanically linked to the bolt 320 in one of numerous possible ways that permits relative linear movement of the lock latch 380 relative to the bolt 320. The system 310 further comprises a cam 382 and a spring-biased stop 384 that is configured to control the linear position of the lock latch 380 relative to the bolt 320. The cam is secured to the bolt in such a way as to permit rotational movement of the cam 382 relative to the bolt 320, permitting one end of the cam 382 to control the position of the lock latch 380. The cam is preferred biased via a spring or other mechanical means, for example, to remain in the vertical position as shown such that when any force is released from the cam, the cam will return to the vertical position. Referring to FIG. 12B, one embodiment of the spring-biased stop 384 comprises a button 384*a* secured to a spring 384*b* mounted to an interior wall of actuator housing 324. In the position shown, the cam 382 is in a vertical position to engage the stop 384 by depressing the button 384*a* against the spring 384*b*.

Figure 12C:
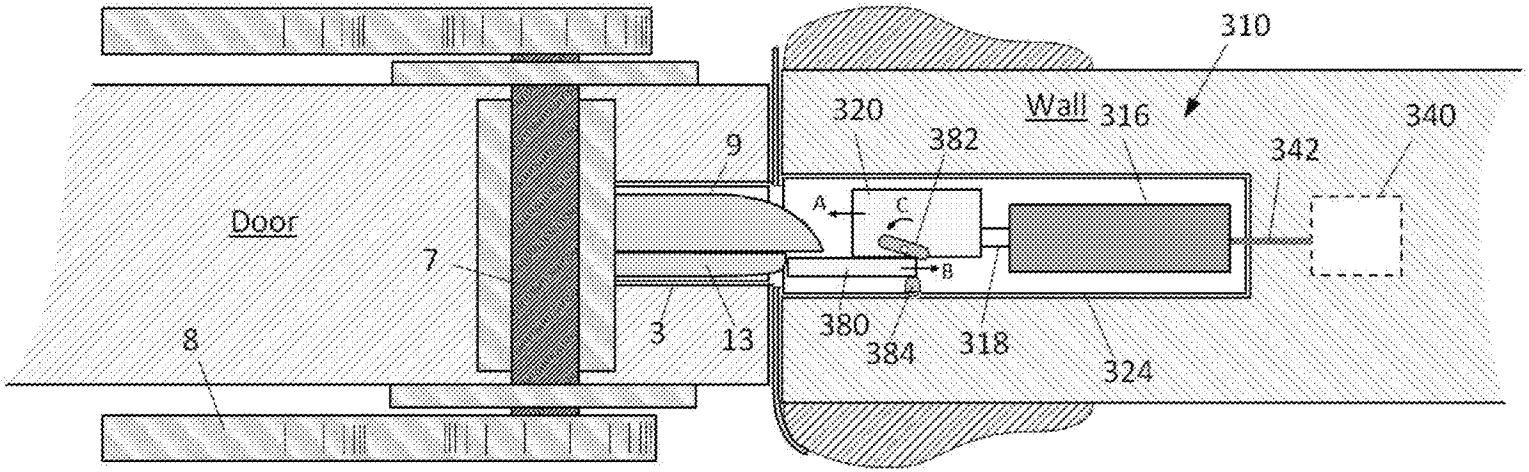
Figure 12D:
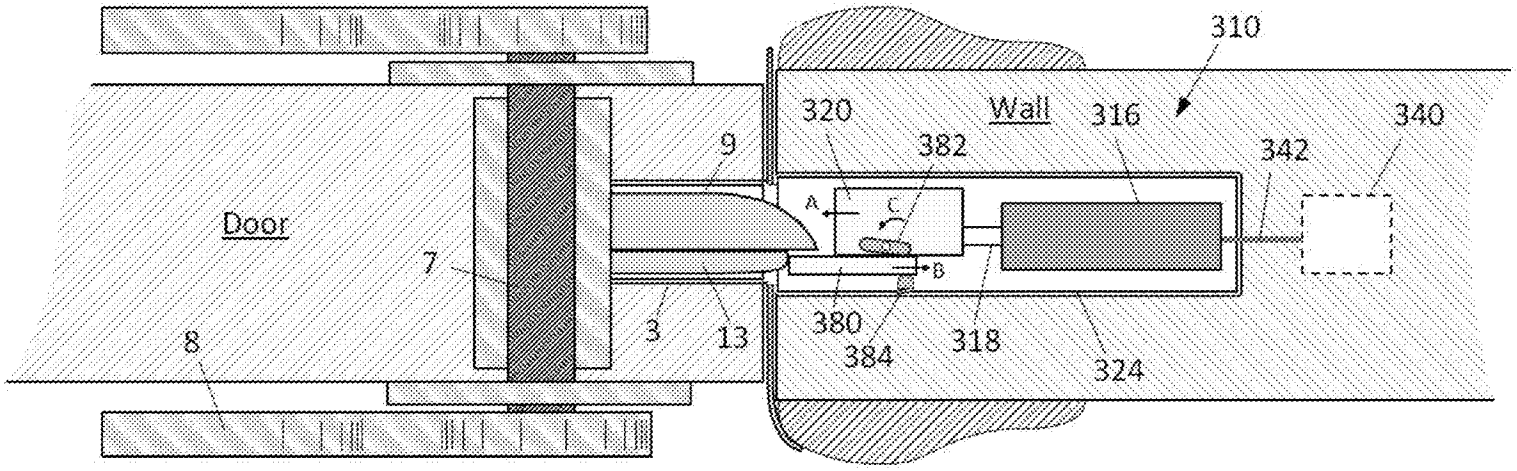

Referring to FIG. 12C, it may be appreciated that in one example of embodiment 310, actuation of the actuator 316 to move the bolt outwardly in the direction of arrow A toward the Door causes the lock latch 380 to push inwardly in the direction of arrow B against cam 382 so that the cam moves counterclockwise, as shown by arrow C. Continued movement of the bolt 320 in the direction of arrow A causes further rotation of the cam 382 further releasing the lock latch to continue to move inwardly in the direction of arrow B, as shown in FIGS. 12C and 12D. By doing so, the lock 13 of the Door latch system is released from its locked position, permitting the lock 13 to move outwardly and into actuator housing 324 in the Wall.

Figure 12E:
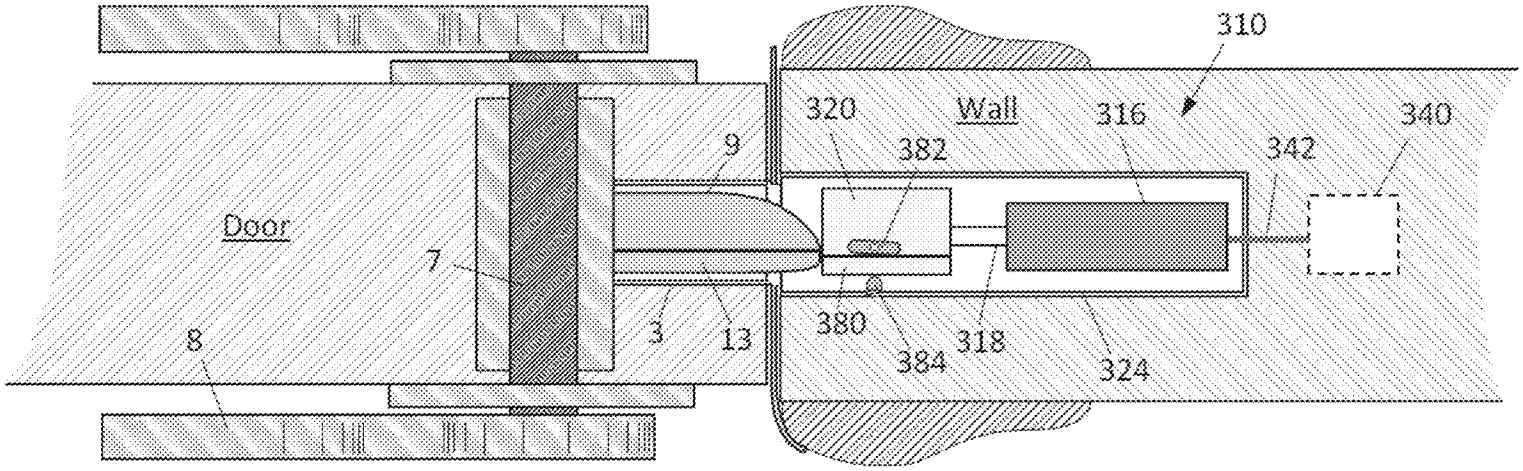
Figure 12F:
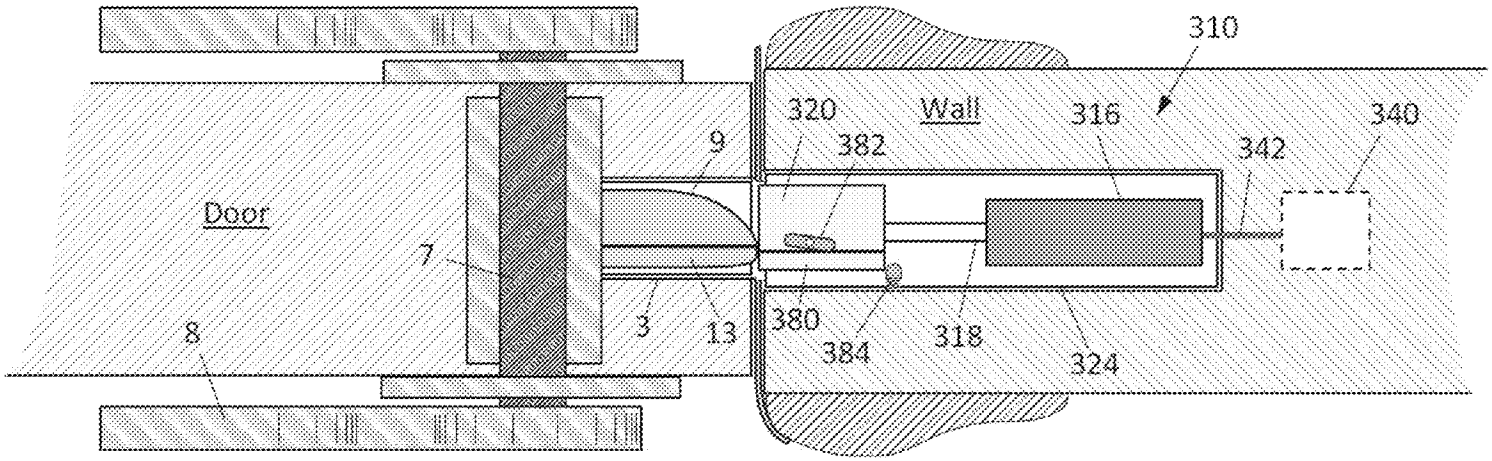

The embodiment is configured and aligned such that, once the bolt 320 has moved outwardly and the lock latch 380 has moved inwardly to a point that they are both essentially flush with each other, as shown in FIG. 12E, the lock 13 of the Door latch system is fully extended and the latch 9 is now in an unlocked position, permitting manual or automated opening of the door. In that regard, further actuation of the actuator 316 moves both the bolt 320 and the lock latch 380 in unison to push both the latch 9 and lock 13 of the Door latch system into opening 3 of the Door until they reach the position shown in FIG. 12F, at which point the Door is release and can be pushed open manually or automatically if the door is spring-hinged in a normally open position.

As described above, the actuator may comprise a solenoid, another type of mechanical or electromechanical device, or a magnetic device where the actuator and bolt are magnetized to be drawn together or repelled away from each other depending upon the desired position of the bolt. Referring to FIG. 13, for example, embodiment 410 comprises an actuator system 412 controlled by control system 414, which may include a controller 440 and a power supply 444. In one example, the actuator system 412 comprises a motor 416 linked to a first end of a threaded drive shaft 418, where the second end of the threaded drive shaft 418 is connected to the bolt 420 via an internal threaded bore 429. Actuation of the actuator 416 turns the drive shaft 418 to move the bolt 420 linearly in an inward or outward direction, similarly as described above with solenoid embodiments.

Persons of ordinary skill in the art may appreciate that numerous design configurations may be possible to enjoy the functional benefits of the inventive systems. For example, it is contemplated that the actuator housing with actuator, shaft and bolt, may be packaged as a replaceable cartridge that can be placed into a Wall or Molding. It is contemplated that such a cartridge may include batteries for powering the actuator, and an internal controller for wireless control by the user, as described above. Such a cartridge would be self-contained, and has the benefit, as with many of the other embodiments described herein, of extending into the Wall beyond what a traditional door jamb would extend—into the Wall studs. Not only is it out of sight, but enjoys a secondary benefit of being more secure when compared to a traditional deadbolt because the Wall studs add greater resistance to forced entry. Thus, given the wide variety of configurations and arrangements of embodiments of the present invention the scope of the invention is reflected by the breadth of the claims below rather than narrowed by the embodiments described above.

What is claimed is:

1. A wall-mountable, electronic, deadbolt system configured for use in automated unlocking of a door that has a combination door latch and door lock whereby the door latch cannot be moved until the door lock has been released, the deadbolt system comprising:

an actuator housing for storing at least a part of an electronically-controlled deadbolt actuator therein, the actuator configured to be operable from a remote controller when in use, the housing being configured to reside within a wall proximate a door to be locked, the actuator housing being configured such that when the deadbolt system resides within the wall, the door latch may reside within a portion of the actuator housing;

a deadbolt mechanically linked to the electronically-controlled actuator to move reciprocally upon actuation of the actuator, the deadbolt configured so that, when the system is in place within a wall proximate the door, the deadbolt can be moved to abut against the end of the door latch, the deadbolt comprising a spring-biased cam lever configured to rotate relative to the deadbolt, the cam lever configured to engage a spring-biased button secured to the actuator housing;

a lock latch connected to the deadbolt and configured to move linearly relative to the deadbolt as the deadbolt is moved linearly by the actuator, the lock latch being configured to abut against the end of the door lock and to permit the deadbolt upon further linear movement thereof to depress the door latch out of the actuator housing, the lock latch of the deadbolt system configured to engage the cam lever when the system is in use to cause the cam lever to rotate relative to the deadbolt when the deadbolt is actuated to depress the door latch clear of the actuator housing, and a programmable controller configured to control actuation of the electronically-controlled actuator and, thus, the deadbolt, the controller configured to be mounted within the wall, the controller further configured for manual and automated operation;

wherein when the system is mounted within the wall and in use, a user can unlock the door via actuation of the deadbolt either by manual operation of the programmable controller or through wireless communication between the user and the programmable controller.

2. The deadbolt system of claim 1, wherein the wireless communication between the user and the programmable controller is via Bluetooth.

* * * * *